US009889532B2

(12) United States Patent
Osaki et al.

(10) Patent No.: US 9,889,532 B2
(45) Date of Patent: Feb. 13, 2018

(54) DOUBLE DISC SURFACE GRINDING MACHINE AND GRINDING METHOD

(71) Applicant: NISSEI INDUSTRY CORPORATION, Toyama-shi (JP)

(72) Inventors: Sajio Osaki, Toyama (JP); Katsuyuki Kyokumoto, Toyama (JP); Minoru Takami, Toyama (JP)

(73) Assignee: NISSEI INDUSTRY CORPORATION, Toyama-shi (JP)

( * ) Notice: Subject to any disclaimer, the term of this patent is extended or adjusted under 35 U.S.C. 154(b) by 0 days.

(21) Appl. No.: 14/902,457

(22) PCT Filed: Jan. 16, 2015

(86) PCT No.: PCT/JP2015/051153
§ 371 (c)(1),
(2) Date: Dec. 31, 2015

(87) PCT Pub. No.: WO2015/108174
PCT Pub. Date: Jul. 23, 2015

(65) Prior Publication Data

US 2016/0207159 A1 Jul. 21, 2016

(30) Foreign Application Priority Data

Jan. 17, 2014 (JP) ..... 2014-007031

(51) Int. Cl.
*B24B 7/17* (2006.01)
*B24B 41/06* (2012.01)
*B24B 5/37* (2006.01)

(52) U.S. Cl.
CPC ..... *B24B 5/37* (2013.01); *B24B 7/17* (2013.01); *B24B 41/06* (2013.01)

(58) Field of Classification Search
CPC .. B24B 7/17; B24B 7/16; B24B 41/06; B24B 5/37
USPC ..... 451/28, 51, 269, 268, 262
See application file for complete search history.

(56) References Cited

U.S. PATENT DOCUMENTS 1,627,858 A * 5/1927 Morgal ..... B24B 7/165 125/11.01
1,956,700 A 5/1934 Shelly

FOREIGN PATENT DOCUMENTS

JP 09-010265 Y1 7/1934
JP H09-10265 Y1 7/1934
(Continued)

OTHER PUBLICATIONS

The International Preliminary Report on Patentability dated Jul. 28, 2016 for International Application No. PCT/JP2015/051153.
(Continued)

*Primary Examiner* — Robert Rose
(74) *Attorney, Agent, or Firm* — Kratz, Quintos & Hanson, LLP

(57) ABSTRACT

A double disc surface grinding machine (10) includes work holding section (65) for holding an inner circumferential surface of an annular work (W) at a plurality of locations. The work holding section (65) includes a plurality of holding members (66) extending radially as viewed from a rotation shaft (46). Each holding member (66) is movable outward and inward radially of the rotation shaft (46), and is contactable to the inner circumferential surface of the work (W). The position adjustment section (76) connects the rotation shaft (46) and the work holding section (65) with each other, and adjusts a position of the work holding section (65) in the radial direction of the rotation shaft (46). While the inner circumferential surface of the work (W) is held by the work holding section (65), the rotation shaft (46), the position adjustment section (76), the work holding section
(Continued)

(65) and the work (W) are rotated integrally with each other around the rotation shaft (46). Part of the rotating work (W) is sandwiched by a pair of grinding wheels (16*a*), (16*b*) to grind two main surfaces of the work (W).

7 Claims, 17 Drawing Sheets

(56) References Cited

FOREIGN PATENT DOCUMENTS

| | | | |
|---|---|---|---|
| JP | S45-5359 | Y1 | 3/1970 |
| JP | Shou 58-102606 | A | 6/1983 |
| JP | H11-239894 | | 9/1999 |
| JP | 2002-96202 | A1 | 4/2002 |
| JP | 2002-96262 | A1 | 4/2002 |
| JP | 2004-42129 | A1 | 2/2004 |
| JP | 2007-229830 | A | 9/2007 |
| JP | 2008-149409 | A1 | 7/2008 |
| WO | 2007099653 | A1 | 9/2007 |

OTHER PUBLICATIONS

International Search Report for International Application No. PCT/JP2015/051153 dated Mar. 3, 2015.
Office Action dated Jan. 12, 2016 for corresponding Japanese Patent Application No. 2015-007269, with English translation.
Extended European Search Report for counterpart EPC Patent Application No. 15737940.5 dated Aug. 17, 2017 (7 Sheets).

* cited by examiner

DOUBLE DISC SURFACE GRINDING MACHINE AND GRINDING METHOD

TECHNICAL FIELD

The present invention relates to double disc surface grinding machines and grinding methods, and more specifically, to a double disc surface grinding machine and a grinding method for grinding two surfaces of middle- and large-sized annular or generally annular works such as piston rings for large marine vessel engines, inner and outer rings of cross roller bearings for rotary tables in machine tools, and inner and outer rings of large bearings in wind-driven power generators.

BACKGROUND ART

Double disc surface grinding machines are conventionally employed to grind works. For example, Patent Literature 1 discloses a double disc surface grinding machine, in which a work has a center hole, where an in-hole driven roller is disposed, and a drive roller and an outer circumferential driven roller are disposed on an outer circumference of the work, whereby the work is held sandwiched by the rollers while being rotatably supported. With this arrangement, a rotating upper wheel and a rotating lower wheel are fed to the work from above and below, and both surfaces of the work is ground simulataneously.

CITATION LIST

Patent Literature

Patent Literature 1: JP-A 2002-96262

SUMMARY OF INVENTION

Technical Problem

When this grinding apparatus simultaneously grinds both surfaces of a large object, such as a piston ring, or an inner or an outer ring of a bearing which has a diameter of approximately 500 mm through 1200 mm, the work moves spontaneously with respect to the in-hole driven roller, the drive roller and the outer circumferential driven roller in a direction in which the pair of grinding wheels are opposed to each other (i.e., in an axial thickness direction of the work). In other words, the work is sandwiched and is supported rotatably by the rollers, and because of this the work moves with respect to each roller, and as a result, the work also moves spontaneously in the direction in which the pair of grinding wheels are opposed to each other during the grinding operation. Consequently therefore, if the work has a warp which may look a mountain-shape or an s-shape as shown in FIG. 16(*a*) and (*b*), on its surfaces to be ground when the work is sandwiched by the pair of grinding wheels, the warp will cause the portion which is not sandwiched by the grinding wheels to vibrate, flail or violently swing depending upon the extent of the warp, with the sandwiching grinding wheels working as a fulcrum point as shown in FIG. 17, as the work is rotated. This interferes with smooth rotation of the work on the roller, making the work snaking or vibrating during the rotation, leading to a problem that a good level of grinding accuracy cannot be achieved. The work's flailing movement when the work is sandwiched between the two grinding wheels becomes greater if the amount of warp is greater. In other words, grinding accuracy decreases further if the work has a greater warp. Also, the work's distortion/warp is greater if the work's diameter is larger and the work's wall thickness (radial thickness) is thinner. Likewise, the work is less rigid if the work's axial thickness is smaller. These mean that so called thin-walled works, such as bearing outer rings and piston rings are more difficult to grind.

When grinding a large, thin-walled work with the grinding apparatus according to Patent Literature 1, all of the three rollers, i.e., the in-hole driven roller, the drive roller and the outer circumferential driven roller are substantially aligned on a single straight line. In other words, work supporting points are eccentrically-located, and it is not possible to hold the work stably.

Therefore, a primary object of the present invention is to provide a double disc surface grinding machine capable of holding various works stably and grinding them at a high grinding accuracy, and a grinding method therefor.

Solution to Problem

According to an aspect of the present invention, there is provided a double disc surface grinding machine for grinding two main surfaces of an annular work. The machine includes a pair of rotary grinding wheels opposed to and spaced from each other in a first direction; a rotation shaft extending in the first direction; a work holding section for holding an inner circumferential surface of the work at a plurality of locations; a position adjustment section connecting the rotation shaft and the work holding section to each other for adjusting a position of the work holding section radially of the rotation shaft; a rotation-driving section for integrally rotating the rotation shaft, the position adjustment section, the work holding section and the work around the rotation shaft while the inner circumferential surface of the work is held by the work holding section; and a grinding wheel feeding section for feeding at least one of the grinding wheels to the work so as to sandwich part of the rotating work between the pair of grinding wheels threreby grinding two main surfaces of the work.

According to another aspect of the present invention, there is provided a method of grinding two main surfaces of an annular work with a pair of rotating grinding wheels opposed to each other in a first direction at a space therebetween. The method includes a holding step of holding an inner circumferential surface of the work at a plurality of locations with a work holding section; a rotating step of rotating the work holding section and the work integrally with each other around a rotation shaft which extends in the first direction; and a grinding wheel infeeding step of sandwiching part of the rotating work between the pair of grinding wheels and advancing at least one of the grinding wheels to grind two main surfaces of the work.

According to the invention described above, the inner circumferential surface of the work is held by the work holding section so that the work will not move with respect to the work holding section (in other words, the work will move integrally with the work holding section) during the grinding. Therefore, it is possible to decrease movement of the work with respect to the work holding section in the direction in which the pair of grinding wheels are opposed to each other, during the grinding. Also, the work holding section does not hold any of the two main surfaces (surfaces to be ground) of the work. Therefore, even if there is a warp in the work's surfaces which are to be ground, it is possible to decrease flailing movement of the work during grinding. Further, it is possible to adjust the position of the work holding section in the radial direction of the rotation shaft. This allows to move the work holding section until it makes contact with the inner circumferential surface of the work at a plurality of locations, regardless of the diameter or shape of the inner circumferential surface of the work, and therefore to reliably hold the inner circumferential surface of the work with the work holding section. As a result, it is possible to stably hold the work of a various kinds and achieve good grinding accuracy.

Preferably, the work holding section includes a plurality of holding members extending radially as viewed from the rotation shaft; and each of the holding members is movable radially inward and outward of the rotation shaft, and is contactable to the inner circumferential surface of the work. In this case, since a plurality of holding members which extend radially as viewed from the rotation shaft hold the inner circumferential surface of the work, only a small holding force (a pushing force exerted from the holding member onto the inner circumferential surface of the work) is sufficient at each location of contact on the inner circumferential surface of the work. Also, the holding members may simply be advanced or retracted radially of the rotation shaft to establish easily contact of the holding members with the inner circumferential surface of the work.

Further preferably, the position adjustment section is arranged to allow individual position adjustment of each of the holding members. In this case, position adjustment with respect to the inner circumferential surface of the work can be made individually for each of the holding members. Therefore, it is possible to hold the inner circumferential surface of the work suitably regardless of the kind of the work.

Further, preferably, the position adjustment section is arranged to allow simultaneous position adjustment of the plurality of holding members. In this case, it is possible to perform position adjustment of a plurality of the holding members in a single operation. Therefore, it is possible to perform a task of holding the inner circumferential surface of the work with the plurality of holding members, within a short time.

Preferably, the plurality of holding members include at least a first holding member, a second holding member and a third holding member, which satisfy the following condition that: in the work's inner circumferential surface, with a first location which is defined as a location contacted by the first holding member, a second location which is defined as a location contacted by the second holding member, and a third location which is defined as a location contacted by the third holding member, the second location and the third location are on an opposite side from the side where the first location is, with respect to the rotation shaft; whereas the second location and the third location are on mutually opposite sides from each other with respect to a straight line which passes through the first location and the center of the rotation shaft. In this case, the first holding member, the second holding member and the third holding member are pressed onto the inner circumferential surface of the work. This makes it possible to hold the work by pressing it with a sufficient amount of force with the first holding member, the second holding member and the third holding member. With respect to the rotation shaft as a reference, the second location and the third location are on an opposite side from the first location. In this case, a force applied from the first holding member to the work and forces applied from the second holding member and the third holding member respectively to the work at least include components acting in directions away from each other. Further, with respect to the straight line which passes through the first location and the center of the rotation shaft, the second location and the third location are on mutually opposite sides from each other. In this case, a force applied from the second holding member to the work and a force applied from the third holding member to the work at least include components acting in directions away from each other. As a result of these, it is possible to hold the work more stably.

Further preferably, the rotation shaft and the work are concentric with each other. In this case, it is possible to perform position adjustment of the work holding section with the position adjustment section, and holding of the inner circumferential surface of the work more smoothly.

It should be noted here that in the present invention, the term two main surfaces of the work means a pair of surfaces which connect to the inner circumferential surface of the work. For example, if the work is circular-annular, the two main surfaces of the work refer to a pair of circular-annular surfaces (in other words, two surfaces of the work other than the outer circumferential surface and the inner circumferential surface).

The above-described object and other objects, characteristics, aspects and advantages of the present invention will become clearer from the following detailed description of embodiments of the present invention to be made with reference to the attached drawings.

BRIEF DESCRIPTION OF DRAWINGS

FIG. 1(*a*) is a front view, FIG. 1(*b*) is a plan view and FIG. 1(*c*) is a side view.

FIG. 16(*b*) shows a work having an s-shaped warp.

DESCRIPTION OF EMBODIMENTS

Figure 1:
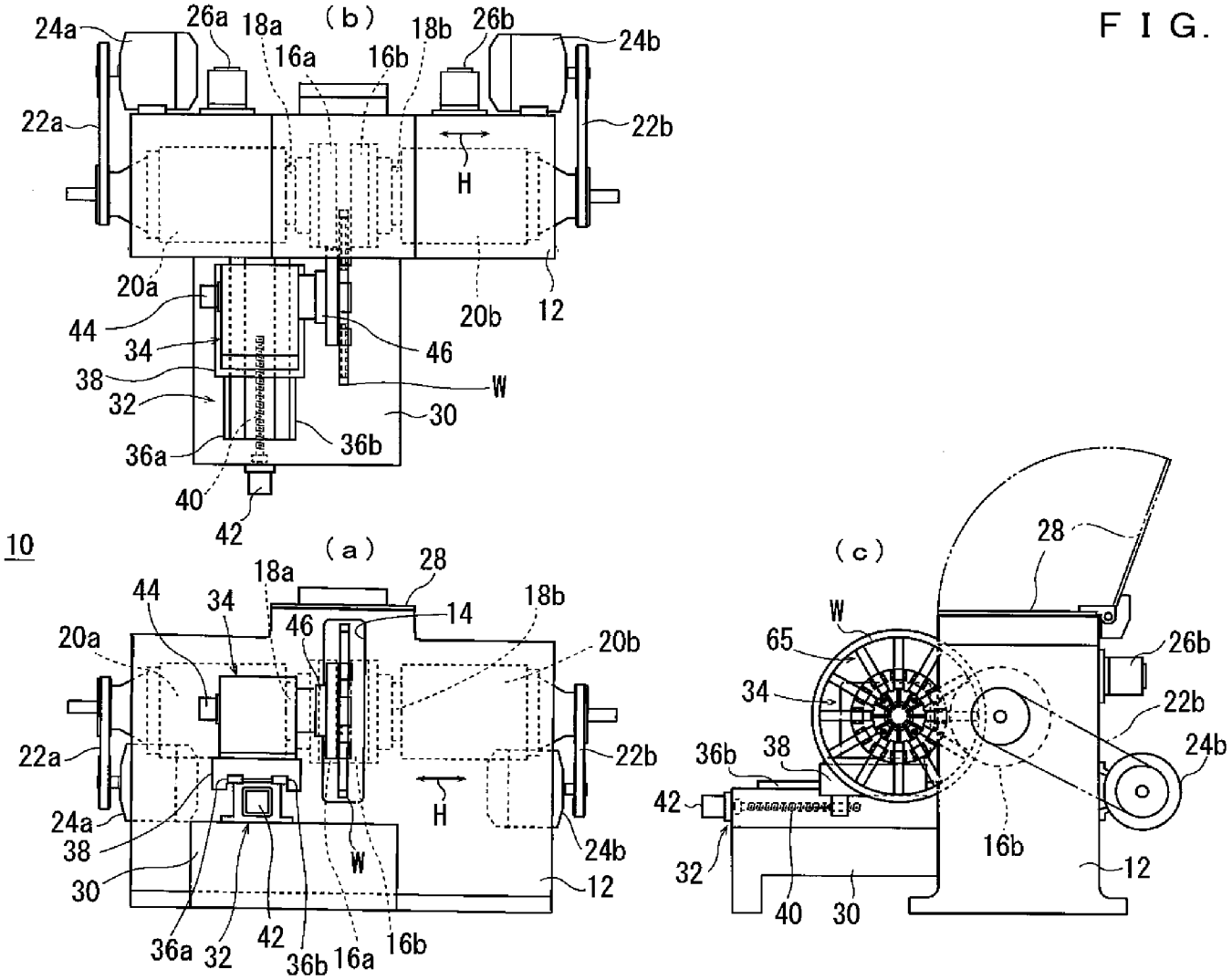
FIG. 1 shows a double disc surface grinding machine according to an embodiment of the present invention.

Hereinafter, embodiments of the present invention will be described with reference to the drawings. Referring to FIG. 1(*a*) through (*c*), a double disc surface grinding machine 10 is a horizontal double disc surface grinding machine, and includes a bed column 12. The bed column 12 has a front surface, at a center region thereof, there is formed an opening 14 extending in an up-down direction. The opening 14 allows a work W to be brought in and out of the bed column 12. Inside the bed column 12, a pair of grinding wheels 16*a*, 16*b* for grinding the work W is opposed coaxially to each other with a gap therebetween in an arrow H direction (in a horizontal direction in the present embodiment). In the present embodiment, the arrow H direction represents the first direction, and each of the grinding wheels 16*a*, 16*b* is circular-annular in a side view. Also, in the present embodiment, the work W is circular-annular in a side view, and the work W has an inner circumferential surface which has a circular section.

The pair of grinding wheels 16*a*, 16*b* are supported by the grinding wheel shafts 18*a*, 18*b*. The grinding wheel shafts 18*a*, 18*b* are supported by the grinding wheel shaft units 20*a*, 20*b* rotatably and movably in a horizontal direction, and are driven by the drive motors 24*a*, 24*b* via belts 22*a*, 22*b*. Therefore, rotational driving forces from the drive motors 24*a*, 24*b* are transmitted via the belts 22*a*, 22*b*, to the grinding wheel shafts 18*a*, 18*b*, whereby the grinding wheels 16*a*, 16*b* are rotated.

The grinding wheel shafts 18*a*, 18*b* are each movable horizontally by grinding wheel feeding sections 26*a*, 26*b*. As the grinding wheel shafts 18*a*, 18*b* are moved horizontally by the grinding wheel feeding sections 26*a*, 26*b*, the pair of grinding wheels 16*a*, 16*b* are moved horizontally. The bed column 12 has an upper surface, at a center region of which there is provided a lid 28 which is openable/closable.

The bed column 12 has a front surface, where a front bed 30 is disposed. The front bed 30 supports a transport section 32 and a rotation-driving section 34.

The transport section 32 includes a pair of guide rails 36*a*, 36*b*, a work table 38, a table mover screw 40 and a drive motor 42. The pair of guide rails 36*a*, 36*b* is formed to extend in a fore-aft direction on the front bed 30. In other words, the pair of guide rails 36*a*, 36*b* are disposed to cross at right angles with the grinding wheel shafts 18*a*, 18*b*. The work table 38 is disposed slidably on the pair of guide rails 36*a*, 36*b*. The table mover screw 40 is connected to a lower surface of the work table 38. The drive motor 42 is connected to the table mover screw 40. When the drive motor 42 is driven, the table mover screw 40 is rotated, whereby the work table 38 is slid on the guide rails 36*a*, 36*b*, moving closer to or away from the bed column 12. The arrangement makes the work W movable to and away from the pair of grinding wheels 16*a*, 16*b*. The rotation-driving section 34 is disposed on the work table 38, and includes a drive motor 44. At an end region of the rotation-driving section 34, a rotation shaft 46 extends in the arrow H direction to rotate the work W. The rotation-driving section 34 is driven by the drive motor 44, and rotates the rotation shaft 46 to rotate the work W.

Figure 2:
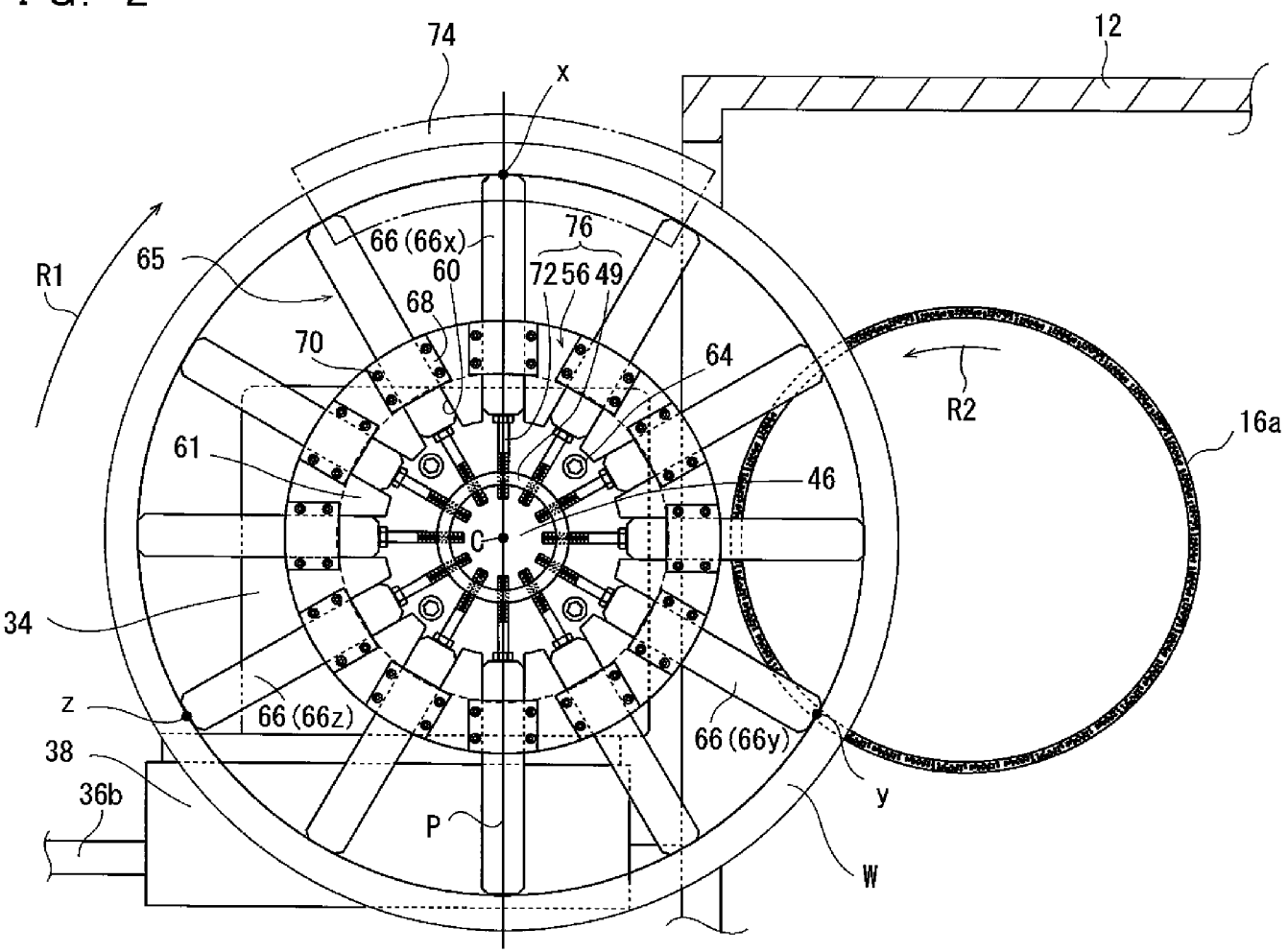
FIG. 2 is an illustrative side view which shows a primary portion of the double disc surface grinding machine in FIG. 1.
Figure 3:
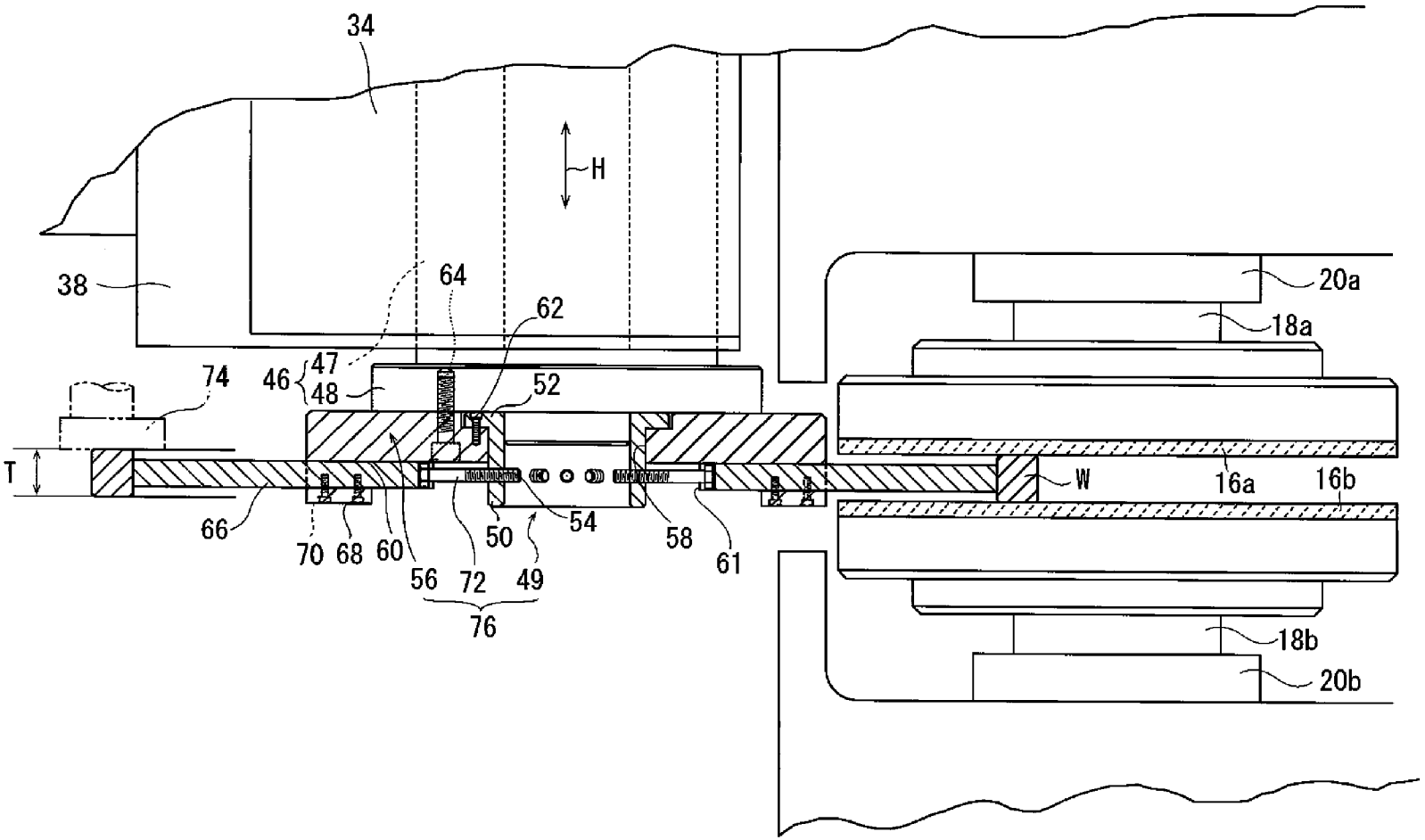
FIG. 3 is an illustrative sectional view which shows a primary portion of the double disc surface grinding machine in FIG. 1.

Referring to FIG. 2 and FIG. 3, the rotation shaft 46 includes a cylindrical section 47 extending in the arrow H direction and a flange-like disc section 48 formed at an end region of the cylindrical section 47. A generally cylindrical screw ring 49 is provided at a center region in the disc section 48 of the rotation shaft 46. The screw ring 49 includes a cylindrical section 50 and a flange section 52 formed at an end region of the cylindrical section 50. The cylindrical section 50 has its side surface formed with a plurality (twelve, in the present embodiment) of screw holes 54 substantially equidistantly in a circumferential direction.

The screw ring 49 is attached to a base flange 56. The base flange 56 is substantially hollow and disc-like. The base flange 56 has a circular hollow portion 58 to which the screw ring 49 is fitted and a plurality (twelve, in the present embodiment) of guide grooves 60 each formed to correspond to (in line with) one of the screw holes 54 in the screw ring 49. Each of the guide grooves 60 extends radially (in a radial direction) of the base flange 56. The plurality of guide grooves 60 are disposed substantially equidistantly in a circumferential direction of the base flange 56. In other words, the base flange 56 has a plurality (twelve, in the present embodiment) of protrusions 61 formed substantially equidistantly in the circumferential direction of the base flange 56, and the guide grooves 60 are formed between mutually adjacent ones of the protrusions 61. While the cylindrical section 50 of the screw ring 49 is fitted to the hollow portion 58, the flange section 52 of the screw ring 49 is attached to the base flange 56 with fasteners 62. Then, the base flange 56, to which the screw ring 49 is attached, is fixed to a shaft end region of the rotation shaft 46 (to the disc section 48) with a plurality (four, in the present embodiment) of fasteners 64. In this state, the rotation shaft 46, the screw ring 49 and the base flange 56 are coaxial with each other and rotatable simultaneously. A work holding section 65 is disposed in the base flange 56. The work holding section 65 includes a plurality (twelve, in the present embodiment) of strip-like holding members 66. Each holding member 66 is fitted into the guide groove 60 of the base flange 56 so that it can slide accurately, and is disposed radially (in a radial direction) of the base flange 56. The plurality of holding members 66 are disposed substantially equidistantly in a circumferential direction of the base flange 56. Also, in order to prevent the holding members 66 from being ground by the grinding wheels 16*a*, 16*b*, each holding member 66 has a thickness which is thinner than an axial thickness T of the work W. The holding member 66 on the guide groove 60 is sandwiched by the base flange 56 and a guide plate 68. The guide plate 68 is attached to the base flange 56 with fasteners 70. The guide plate 68 as described above guides the holding member 66 to slide smoothly, without rattling or moving out of the guide groove 60. Adjustment screws 72 are threaded into the screw holes 54 in the screw ring 49. The adjustment screw 72 is disposed in line with the holding member 66 so that a head portion of the adjustment screw 72 can push an end of the holding member 66. By rotating (clockwise or counterclockwise) the adjustment screws 72 with a jig such as a torque wrench, the adjustment screws 72 and the holding members 66 can be moved radially outward/inward of the rotation shaft 46 with respect to an inner circumferential surface of the work W. The adjustment screws 72 are driven to move in the circumferential direction thereby pushing the holding members 66 outward until tip portions of the holding members 66 make pressing contact onto the inner circumferential surface of the work W. By doing so, the inner circumferential surface of the work W receives an appropriate amount of radially outward pressure evenly from a plurality (twelve, in the present embodiment) of the holding members 66, and the work W is held by the plurality of holding members 66 in an outwardly expanding (pushed from inside out) fashion. Above the base flange 56, a guiding plate 74 is provided to assist positioning of the work W when the work W is set onto the holding members 66. The guiding plate 74 is movable in an axial direction of the rotation shaft 46, and is moved back to a predetermined position by an unillustrated advancement/retraction drive motor when the setting of the work W onto the holding members 66 is completed.

In the present embodiment, as shown in FIG. 2, twelve holding members 66 are disposed substantially equidistantly (at an angular interval of approximately 30 degrees) in a circumferential direction. Therefore, it is clear that the work holding section 65 (a plurality of the holding members 66) includes the first holding member, the second holding member and the third holding member which satisfy the condition stated as "In the work's inner circumferential surface, with the first location which is defined as a location contacted by the first holding member, the second location which is defined as a location contacted by the second holding member, and the third location which is defined as a location contacted by the third holding member, the second location and the third location are on an opposite side from the side where the first location is, with respect to the rotation shaft; and the second location and the third location are on mutually opposite sides from each other with respect to a straight line which passes through the first location and the center of the rotation shaft". Referring to FIG. 2, using the clock reading system, the holding member 66 which points the "12 o'clock" position will be called the first holding member 66*x;* the holding member 66 which points the "4 o'clock" position will be called the second holding member 66*y;* the holding member 66 which points the "8 o'clock" position will be called the third holding member 66*z,* for example. Then a location where the first holding member 66*x* makes contact with the work W is the first location x; a location where the second holding member 66*y* makes contact with the work W is the second location y; and a location where the third holding member 66*z* makes contact with the work W is the third location z. In this case, with respect to the rotation shaft 46, the second location y and the third location z are on an opposite side from the first location x; whereas with respect to a straight line P which passes through the first location x and the center C of the rotation shaft 46, the second location y and the third location z are on mutually opposite sides from each other. In the present embodiment, the position adjustment section 76 includes the screw ring 49, the base flange 56 and the adjustment screws 72. It is possible with the position adjustment section 76, to connect the rotation shaft 46 and the work holding section 65 and to adjust the position of the work holding section 65 radially of the rotation shaft 46.

Next, description will be made for a method of setting the work holding section 65 (a plurality of the holding members 66) to the work W.

First, a set of four holding members 66 which are in a crisscross relationship in the twelve holding members 66 are set to an extending length which is shorter than the inner radius of the work W by approximately 0.5 mm. All of the other holding members 66 are set to a shorter extending length than these four. Next, one surface of the work W is pressed onto the guiding plate 74, to position the work W. Next, the four holding members 66 in the cross pattern are divided into two sets, with each set consisting of two holding members 66 which are in a rightly opposed relationship to each other. In each set, the two holding members 66 are alternately pushed radially outward. In this process, the adjustment screw 72 is turned with a torque wrench for example, whereby the holding member 66 is pushed. Then, once all of the four holding members 66 make contact with the inner circumferential surface of the work W, the holding members 66 are alternately torqued in each set, to a predetermined torque. Likewise, the remaining holding members 66 are divided into sets of two rightly opposed holding members 66, and in each set the holding members 66 are alternately torqued to the predetermined torque. Following the process described above, the inner circumferential surface of the work W is held by the work holding section 65 (a plurality of the holding members 66).

Figure 4:
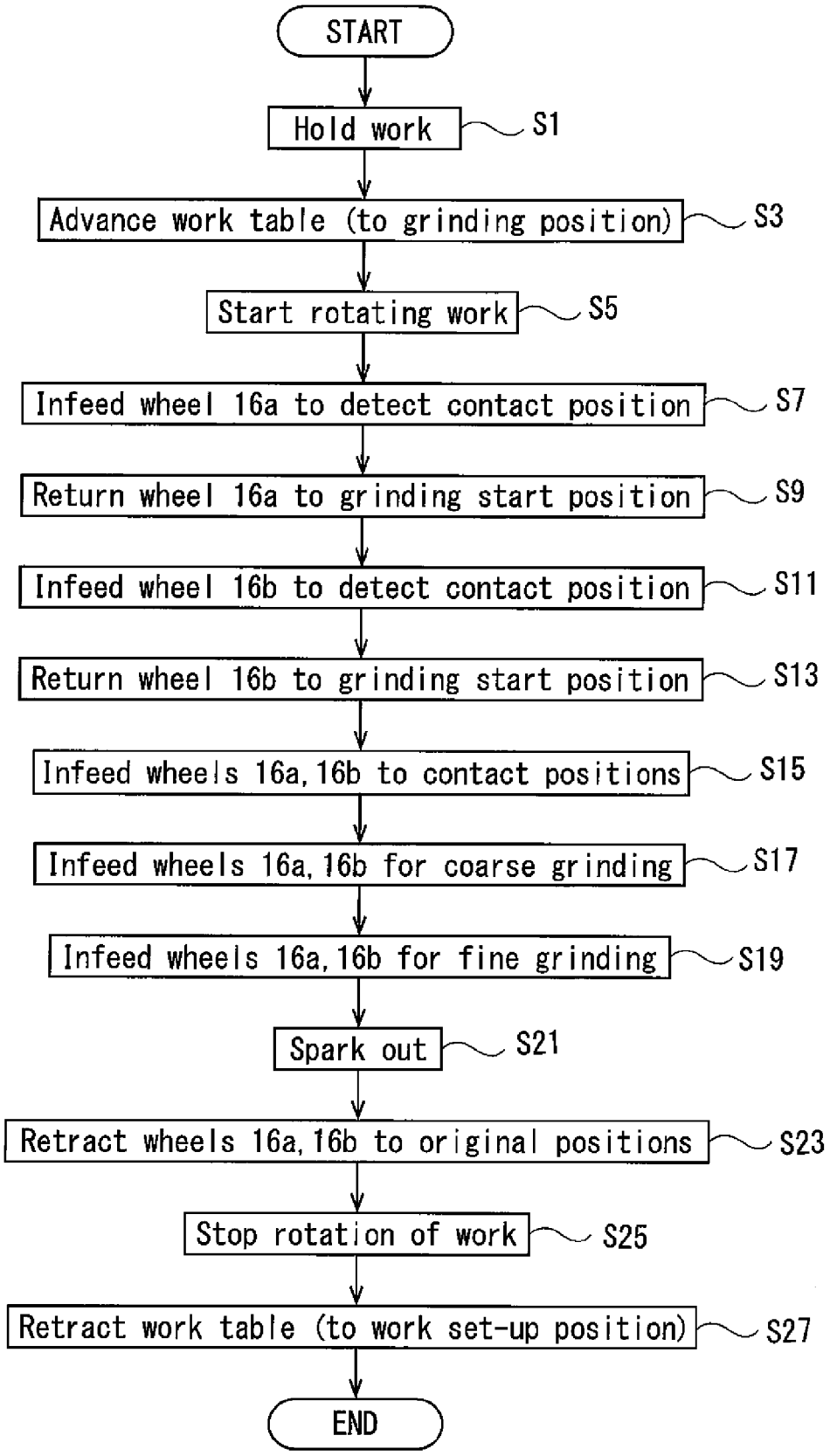
FIG. 4 is a flowchart which shows an example of operation of the double disc surface grinding machine in FIG. 1.

Next, a primary operation of the double disc surface grinding machine 10 will be described with reference to FIG. 4.

First, the work W is held with the work holding section 65 as described above (Step S1). Next, the work table 38 is moved forward by the transport section 32, toward the bed column 12 to move the work W, which is held by the work holding section 65, to a grinding position. In other words, the work W is sent to between the pair of grinding wheels 16*a,* 16*b* (Step S3).

Next, the rotation-driving section 34 rotates the work W (Step S5). Specifically, a driving force from the drive motor 44 rotates the rotation shaft 46 integrally with the position adjustment section 76, the work holding section 65 and the work W, around the rotation shaft 46 in a direction indicated by an arrow R1 in FIG. 2.

Next, the drive motors 24*a,* 24*b* rotate the grinding wheels 16*a,* 16*b* respectively, in a direction indicated by an arrow R2 in FIG. 2. Simultaneously therewith, the grinding wheel feeding section 26*a* moves the left (see FIG. 1) grinding wheel 16*a* forward, toward the work W. As the grinding wheel 16*a* makes contact with the work W, an unillustrated sensor detects a position where the contact was established (Step S7). Thereafter, the grinding wheel 16*a* is returned to its grinding start position (Step S9).

Next, the grinding wheel feeding section 26*b* moves the right (see FIG. 1) grinding wheel 16*b* forward, toward the work W. As the grinding wheel 16*b* makes contact with the work W, an unillustrated sensor detects a position where the contact was established (Step S11). Thereafter, the grinding wheel 16*b* is returned to its grinding start position (Step S13).

Next, the left and right grinding wheels 16*a,* 16*b* are advanced to the positions of contact (Step S15), then a coarse grinding infeed is performed with the grinding wheels 16*a,* 16*b* (Step S17), and further, a fine grinding infeed is performed with the grinding wheels 16*a,* 16*b* (Step S19). Although the pair of grinding wheels 16*a,* 16*b* sandwich only part of the work W at any moment, the work W is rotating and therefore all parts of the surfaces of the work W which must be ground make passes between the pair of grinding wheels 16*a,* 16*b,* allowing both main surfaces of the work W to be ground simultaneously. Then, after a spark out (Step S21), the grinding wheels 16*a,* 16*b* are returned to their original positions (Step S23). Then, rotation of the work W is stopped (Step S25), and the work table 38 recedes from the bed column 12 to the location where the work W is removed/mounted (Step 27).

A cycle of Step S1 through Step S27 is repeated to sequentially grind a plurality of the works W.

Hereinafter, functions and advantages of the double disc surface grinding machine 10 will be explained.

According to the double disc surface grinding machine 10, the inner circumferential surface of the work W is held by the work holding section 65 so that the work W will not move with respect to the work holding section 65 (in other words, the work W will move integrally with the work holding section 65) during the grinding. Therefore, it is possible to decrease movement of the work W with respect to the work holding section 65 in the direction in which the pair of grinding wheels 16*a*, 16*b* are opposed to each other, during the grinding. The work holding section 65 does not hold two main surfaces (surfaces to be ground) of the work W. Therefore, even if the work W has warps in its surfaces to be ground, it is possible to decrease flailing movement of the work W during grinding. In other words, regardless of whether or not the work W has a warp, distortion, etc. in its surfaces to be ground, it is possible: to hold the inner circumferential surface of the work W with the work holding section 65 so that the rotation shaft 46, the position adjustment section 76, the work holding section 65 and the work W will rotate integrally with each other; to grind the work W based on the rotation shaft 46; and to reduce flailing movement of the work W during grinding.

It is possible to adjust the position of the work holding section 65 in the radial direction of the rotation shaft 46. This allows to move the work holding section 65 until it makes contact with the inner circumferential surface of the work W at a plurality of locations, regardless of the diameter or shape of the inner circumferential surface of the work W, and therefore to reliably hold the inner circumferential surface of the work W with the work holding section 65. It is possible to stably hold the work W of a various kinds. As a result, it is possible to use grinding wheels 16*a*, 16*b* of a small diameter when grinding the work W regardless of the diameter, warp, etc. of the work W; to ensure appropriate parallelism and flatness regarding the surfaces of the work W to be ground; to obtain good grinding accuracy; and to provide accuracy as reference surfaces used in a later process of machining on the inner and outer diameters.

A plurality of the holding members 66 which extend radially as viewed from the rotation shaft 46 hold the inner circumferential surface of the work W. Therefore, at each location of contact on the inner circumferential surface of the work W, only a small holding force (a pushing force exerted from the holding member 66 onto the inner circumferential surface of the work W) is sufficient. The holding members 66 may simply be advanced or retracted radially of the rotation shaft 46, to establish easily contact of the holding members 66 with the inner circumferential surface of the work W.

Figure 5:
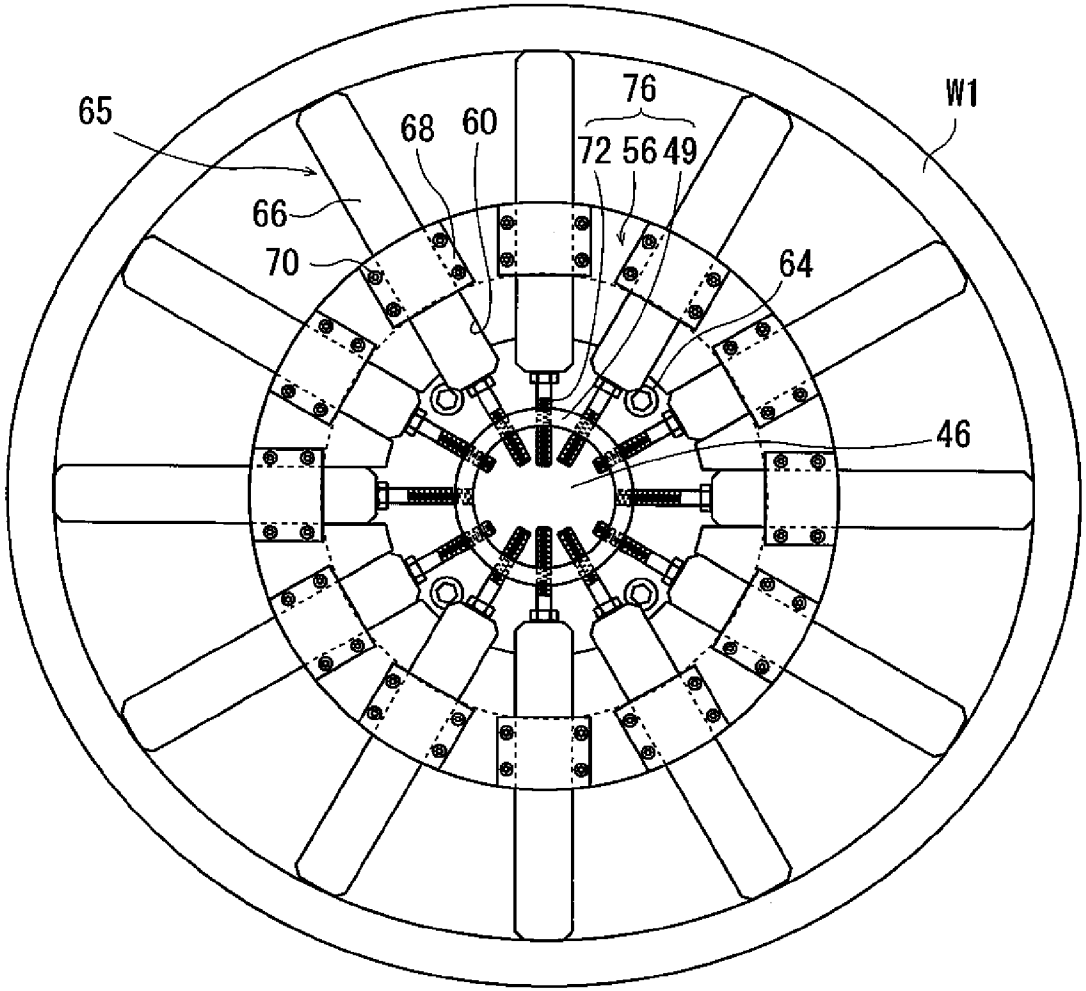
FIG. 5 shows a case where an oval-annular work is held by the double disc surface grinding machine in FIG. 1.

Position adjustment with respect to the inner circumferential surface of the work W can be made individually for each of the holding members 66. Therefore, it is possible to hold the inner circumferential surface of the work W suitably regardless of the kind of the work W. In other words, the inner circumferential surface of the work W need not necessarily be a true circle. It is possible to handle annular works having various shapes other than circler, such as oval, rectangular, hexagonal or rice-ball shaped. For example, it is possible to handle an oval-annular work W1 as shown in FIG. 5.

Referring to FIG. 2, as the first holding member 66*x*, the second holding member 66*y* and the third holding member 66*z* are pressed onto the inner circumferential surface of the work W, the first holding member 66*x*, the second holding member 66*y* and the third holding member 66*z* press thereby hold the work W with sufficient amount of forces. With respect to the rotation shaft 46 as a reference, the second location y and the third location z are on an opposite side from the first location x. In this case, a force applied from the first holding member 66*x* to the work W and forces applied from the second holding member 66*y* and the third holding member 66*z* respectively to the work W at least include components acting in directions away from each other. Further, with respect to the straight line P which passes through the first location x and the center C of the rotation shaft 46, the second location y and the third location z are on opposite sides from each other. In this case, the force applied from the second holding member 66*y* to the work W and the force applied from the third holding member 66*z* to the work W at least have components acting in directions away from each other. As a result of these, it is possible to hold the work W more stably.

Since the rotation shaft 46 and the work W are concentric with each other, it is possible to perform position adjustment of the work holding section 65 with the position adjustment section 76 and holding on the inner circumferential surface of the work W more smoothly.

Since the work W can be ground from a state of material to a finished size within a single grinding cycle, productivity is improved, and since the grinding wheels 16*a*, 16*b* of a narrow effective grinding width can be used, it is possible to decrease cost on the grinding wheels. Further, it becomes possible to make the double disc surface grinding machine 10 compact.

In the embodiment described above, individual adjustment screws 72 are used to move corresponding ones of the holding members 66 radially outward to hold the inner circumferential surface of the work W. However, as in an embodiment shown in FIG. 6, advancing/retracting movement of all of the holding members 66 may be performed by a single operation by employing an automatic chucking mechanism.

Figure 6:
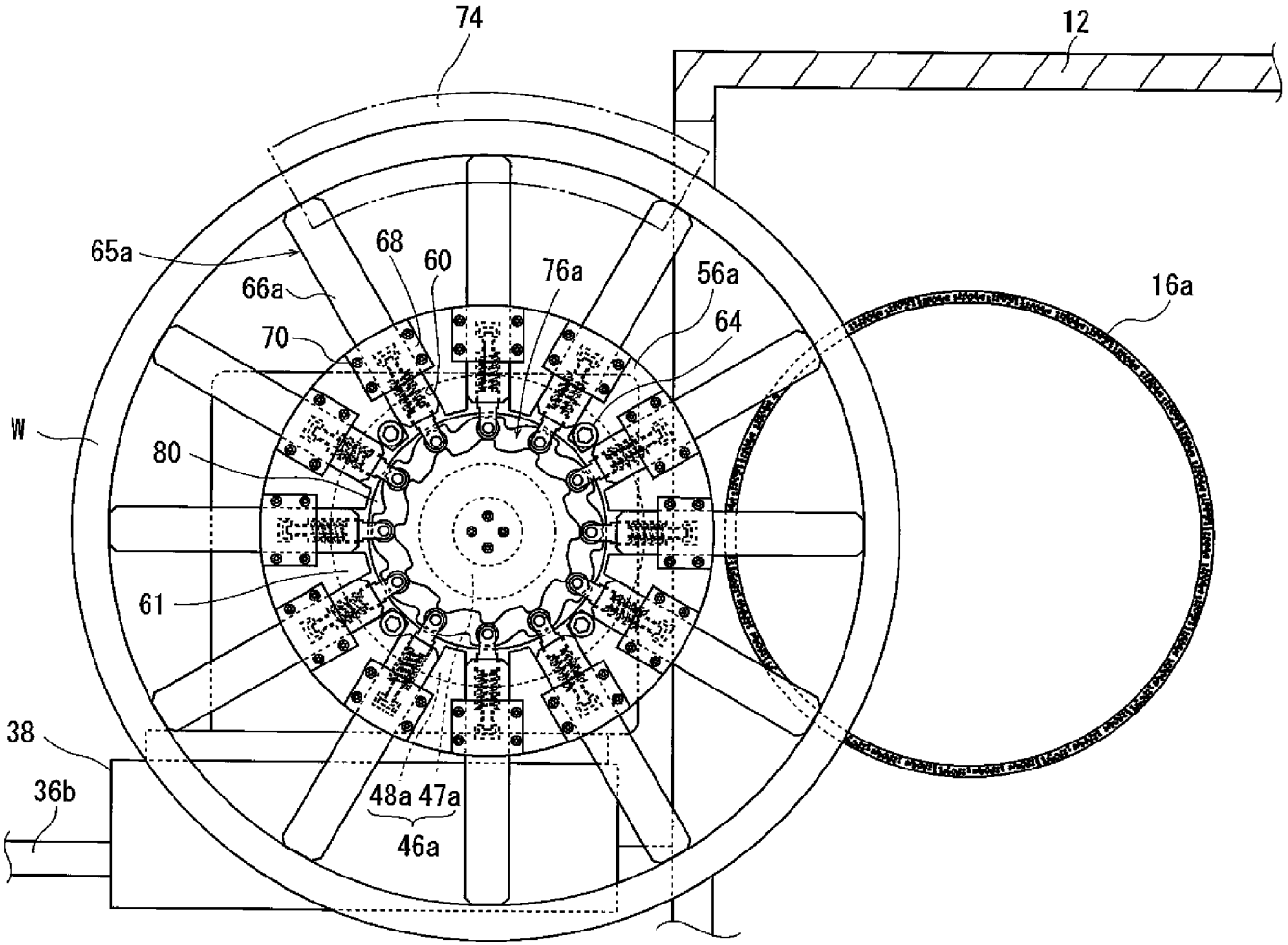
FIG. 6 is an illustrative side view which shows a primary portion of a double disc surface grinding machine according to another embodiment of the present invention.
Figure 7:
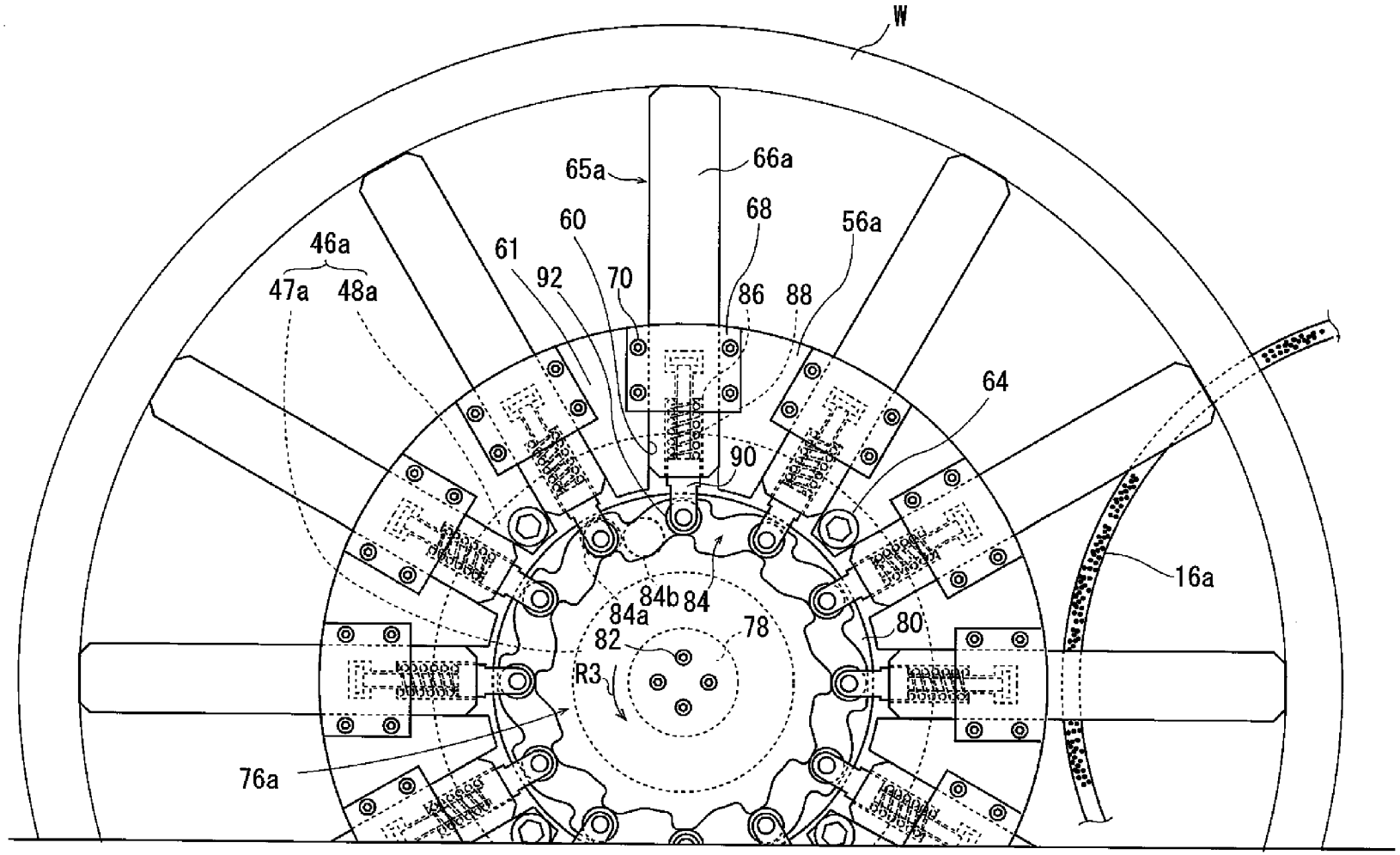
FIG. 7 is an enlarged view which shows a vicinity of a work holding section and a position adjustment section of the double disc surface grinding machine in FIG. 6.

Referring to FIG. 6 and FIG. 7, in the present embodiment, a cam shaft 78 is inserted through the center of the rotation shaft 46*a*, coaxially therewith. In other words, the rotation shaft 46*a* includes a cylindrical section 47*a* extending in the arrow H direction (see FIG. 1) and a flange-like, hollow disc section 48*a* formed at an end region of the cylindrical section 47*a*. The cam shaft 78 is inserted through the cylindrical section 47*a* and the hollow disc section 48*a*. The cam shaft 78 is rotatable with respect to the rotation shaft 46*a*, and is connected to an unillustrated cam rotary-drive actuator. At an end portion of the cam shaft 78, a disc cam 80 is fixed with a plurality (four, in the present embodiment) of fasteners 82. The disc cam 80 includes an annular cam groove 84. The cam groove 84 has the same number of ridges 84*a* and valleys 84*b* as the plurality (twelve, in the present embodiment) of holding members 66*a* included in work holding section 65*a*. Also, in the present embodiment, there is provided a locking mechanism (not illustrated) for fixing the cam shaft 78 to the rotation shaft 46*a* (to make the rotation shaft 46*a* un-rotatable with respect to the cam shaft 78). Therefore, it is possible to fix the cam shaft 78 to the rotation shaft 46*a* with the locking mechanism, under a state where rollers 92, which will be described later, are on the ridges 84*a* or on the valleys 84*b* of the cam groove 84. With this arrangement, by driving the cam rotary-drive actuator while the locking mechanism fixes the cam shaft 78 to the rotation shaft 46*a*, the cam shaft 78 and the rotation shaft 46*a* rotate integrally with each other. Each of the holding members 66*a* is formed with a spring hole 86. In the spring hole 86, a spring 88 and a plunger 90 are inserted. The plunger 90 has an end, to which a roller 92 is attached. The roller 92 is fitted into the cam groove 84. The base flange 56*a* is formed substantially hollow and disc-like. An inner diameter of the base flange 56*a* is substantially equal to an outer diameter of the disc cam 80. The base flange 56*a* is fitted around the disc cam 80, and is fitted to the hollow disc section 48*a* of the rotation shaft 46*a* with a plurality (four, in the present embodiment) of fasteners 64. In the present embodiment, the position adjustment section 76*a* includes the base flange 56*a*, the cam shaft 78, the cam rotary-drive actuator, the disc cam 80, the fasteners 82, the springs 88, the plungers 90 and the rollers 92. Other arrangements are the same as the embodiment in FIG. 1, so repetitive description will not be given here.

In the present embodiment, the work W is set, and then the cam shaft 78 is rotated leftward (counterclockwise (in an arrow R3 direction) in FIG. 7) to cause the disc cam 80 to push up the rollers 92, to press the plungers 90. This causes the holding members 66*a* to be pressed out via the spring 88 which is adjusted to exert an appropriate clamping force, and the inner circumferential surface of the work W is held by all of the holding members 66*a*. In this way, it becomes possible to hold the inner circumferential surface of the work W with all of the holding members 66*a*, by rotating a single cam shaft 78. Then, the unillustrated locking mechanism is used to lock the holding members 66*a* at their work W holding positions, so that the holding members 66*a* can continue to hold the work W with a constant force during grinding.

According to this embodiment, the position adjustment section 76*a* is arranged to be capable of making a simultaneous position adjustment of a plurality of the holding members 66*a*. Therefore, the arrangement allows position adjustment of a plurality of the holding members 66*a* in a single operation. It is possible to perform a task of holding the inner circumferential surface of the work W with a plurality of the holding members 66*a* within a short time.

Figure 8:
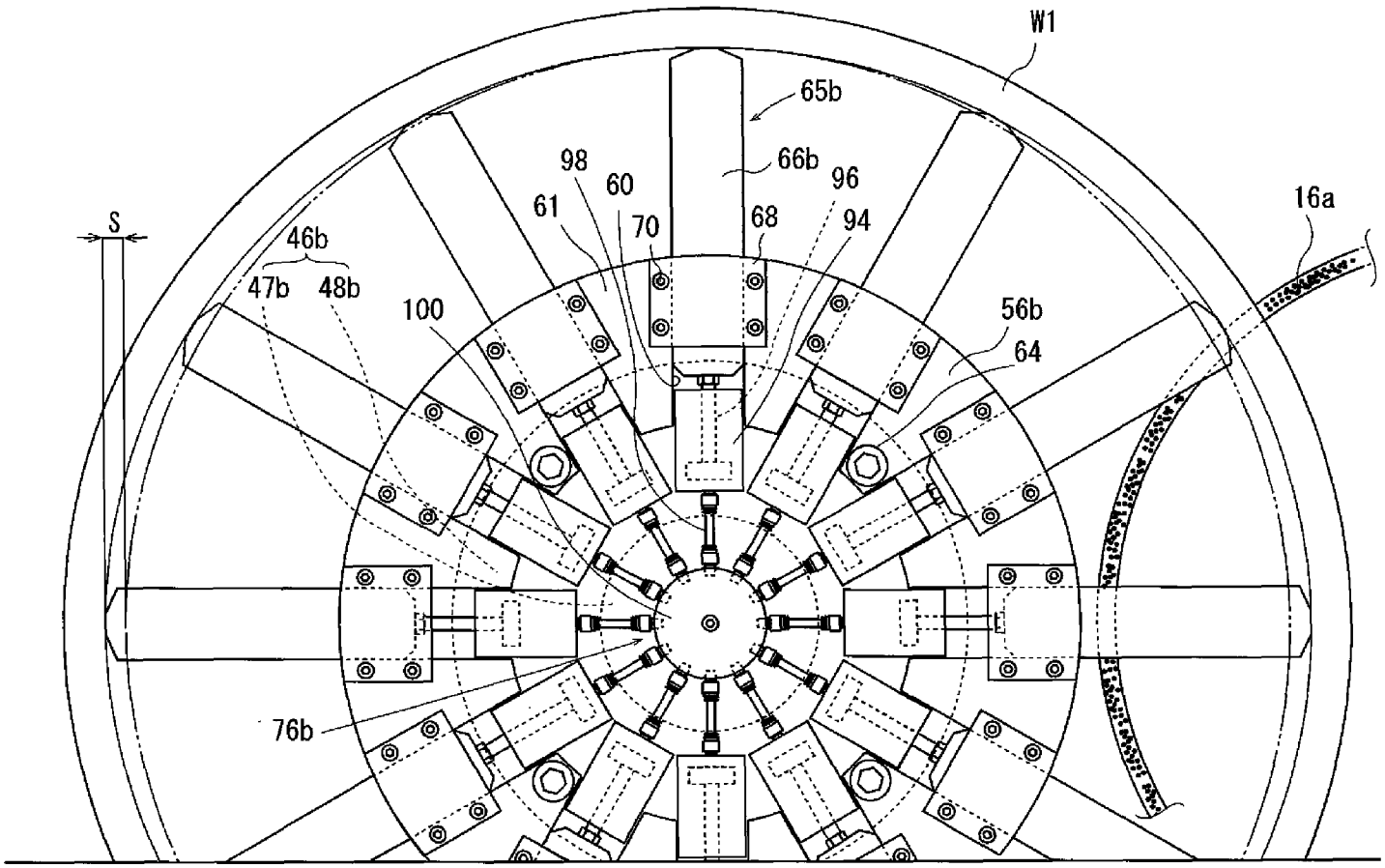
FIG. 8 is a an enlarged view which shows a vicinity of a work holding section and a position adjustment section of a double disc surface grinding machine according to still another embodiment of the present invention (with an oval-annular work held thereby).

FIG. 8 shows an embodiment as another arrangement for causing all of the holding members 66*b* to be advanced or retracted with a single operation. In the present embodiment, an oval work W1 is held by the work holding section 65*b*. A major axis radius of the work WI is longer than a radius of a true circle by a length S.

In the present embodiment, there is provided a plurality (twelve, in the present embodiment) of air cylinders 94 at a base flange 56*b*, together with a plurality (twelve, in the present embodiment) of holding members 66*b* which are included in the work holding section 65*b*. Each of the air cylinders 94 has a piston rod 96, to which a corresponding one of the holding members 66*b* is connected. Each air cylinder 94 is connected to an air supply joint 100 via a corresponding pipe 98. The air supply joint 100 is inserted through the center of the rotation shaft 46*b* coaxially therewith, and is rotatable integrally with the rotation shaft 46*b*. In other words, the rotation shaft 46*b* includes a cylindrical section 47*b* extending in the arrow H direction (see FIG. 1) and a flange-like, hollow disc section 48*b* formed at an end region of the cylindrical section 47*b*. The air supply joint 100 is inserted through the cylindrical section 47*b* and the hollow disc section 48*b*, and fixed to the rotation shaft 46*b*. The air supply joint 100 has an end portion protruding out of an end portion of the rotation shaft 46*b*, and the plurality of the pipes 98 are radially connected to an outer side surface of the end portion of the air supply joint 100. An unillustrated air supply source supplies air through the air supply joint 100 and each of the pipes 98, to each air cylinder 94, then all of the holding members 66*b* move outward to press an inner circumferential surface of the work W1 thereby holding the work W1. The base flange 56*b* is formed substantially hollow and disc-like. An inner diameter of the base flange 56*b* is substantially equal to an outer diameter of the air supply joint 100. The base flange 56*b* is fitted around the air supply joint 100, and is fixed to the hollow disc section 48*b* of the rotation shaft 46*b* with a plurality (four, in the present embodiment) of fasteners 64. In the present embodiment, the position adjustment section 76*b* includes the base flange 56*b*, the air cylinders 94, the pipes 98, the air supply joint 100 and the air supply source. Other arrangements are the same as the embodiment in FIG. 1, so repetitive description will not be given here.

According to this embodiment, it is possible to drive each of the holding members 66*b* individually with a single operation. With the use of air cylinders 94, it is possible to cause all of the holding members 66*b* to press and hold the inner circumferential surface of any work, which has a large inner diametrical difference (e.g., between the major and minor axes) or of a work of an irregular shape, with a uniform force regardless of the extended length (amount of stroke) of the individual holding members 66*b*. The air cylinders may be replaced with hydraulic cylinders. The same applies to embodiments shown in FIG. 12 and FIG. 14.

Figure 9:
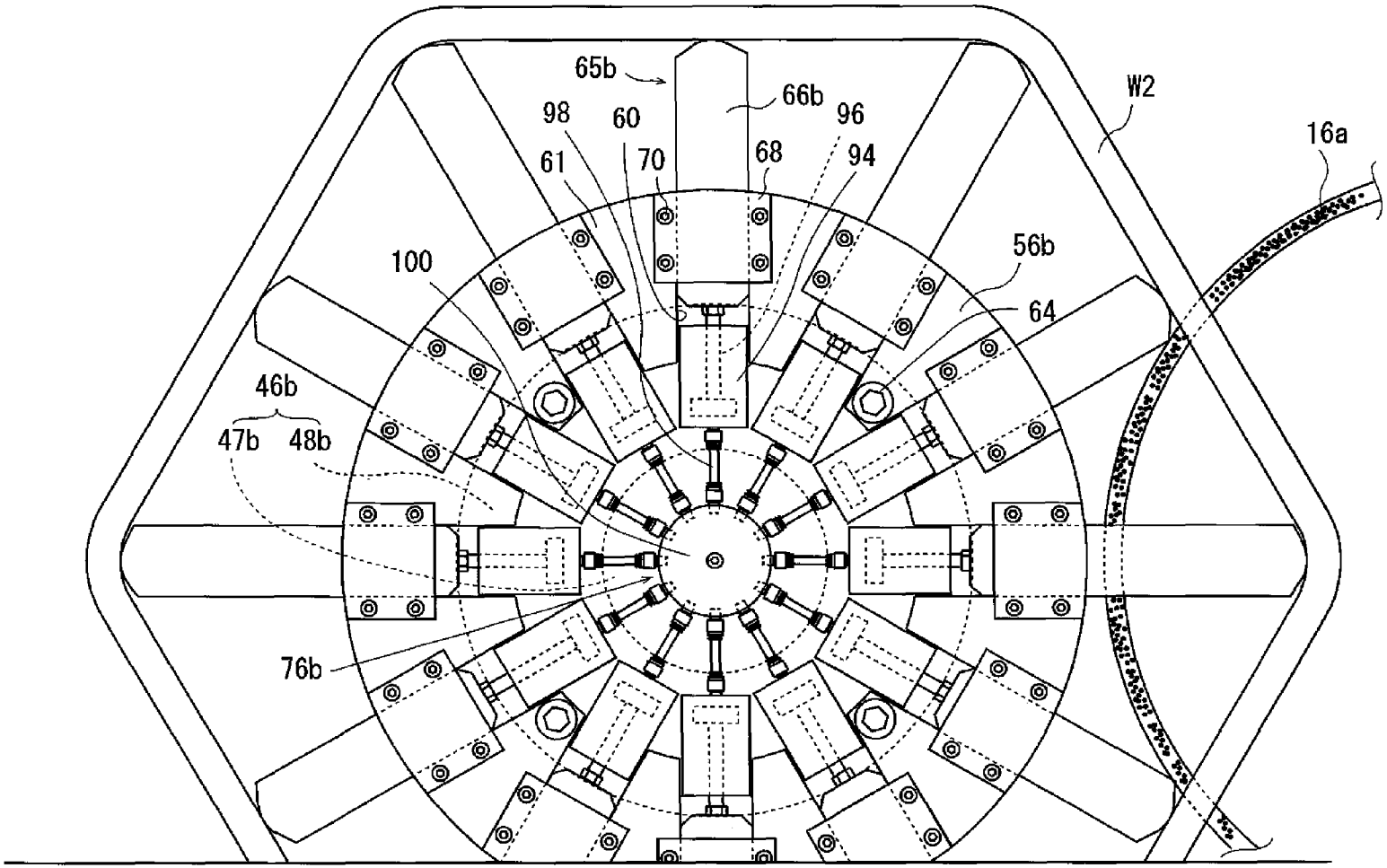
FIG. 9 is an enlarged view which shows a vicinity of the work holding section and the position adjustment section of the double disc surface grinding machine in FIG. 8 (with an prismatic-annular work held thereby).

In the embodiments described above, the holding members may be varied in their length and shape of tips, in accordance with the work to be machined. Then it becomes possible to handle works more flexibly, not only circularly annular works such as inner and outer rings of bearings, inner and outer rings of cross roller bearings, and piston rings but also works of any loop shapes such as triangular, rectangular, etc. For example, the length of each holding member 66*b* in the embodiment shown in FIG. 8 may be changed as shown in FIG. 9. Then, it becomes possible to easily hold a work W2 of a prismatic (hexagonal) ring shape as shown in FIG. 9.

Figure 10:
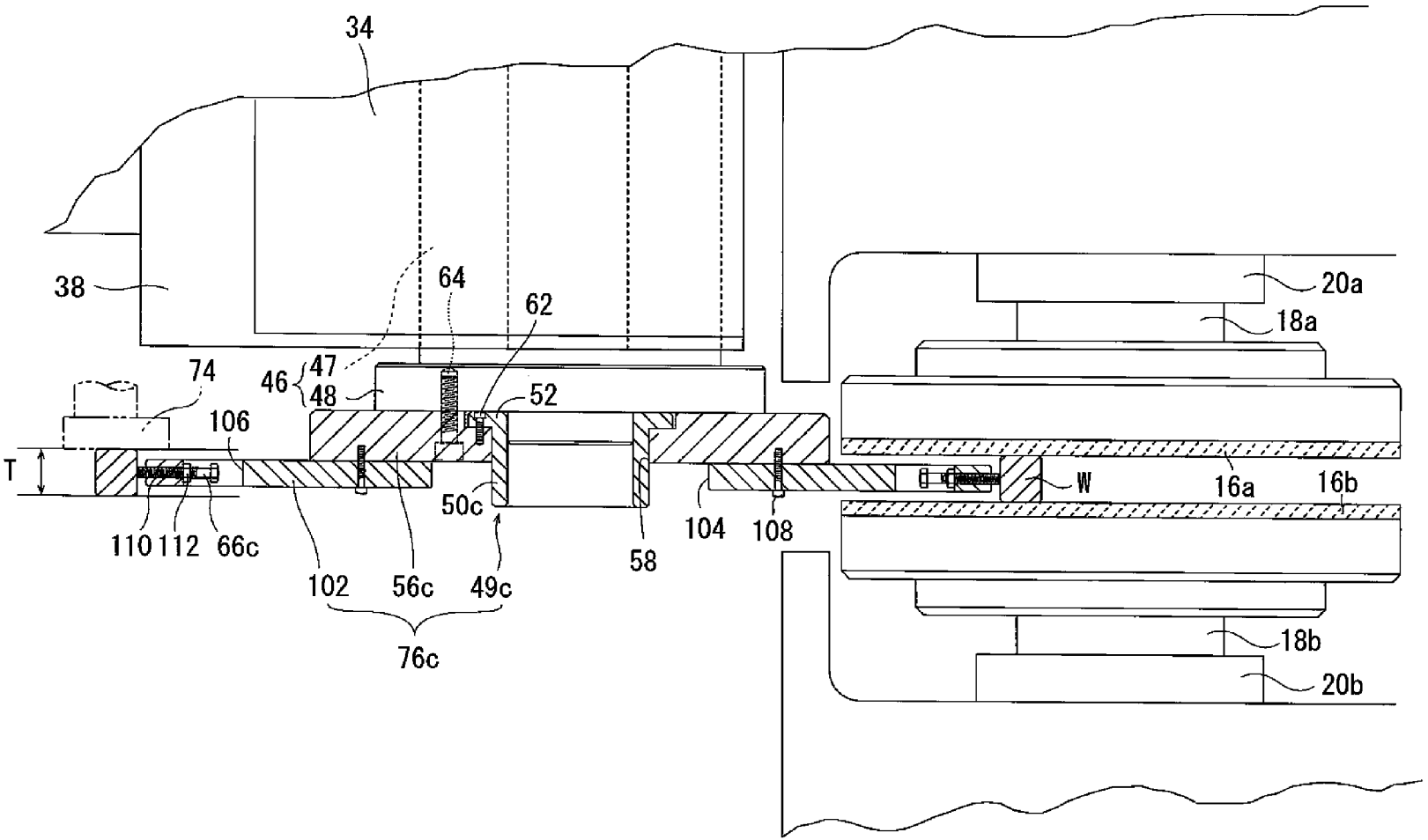
FIG. 10 is an illustrative sectional view which shows a primary portion of a double disc surface grinding machine according to still another embodiment of the present invention.
Figure 11:
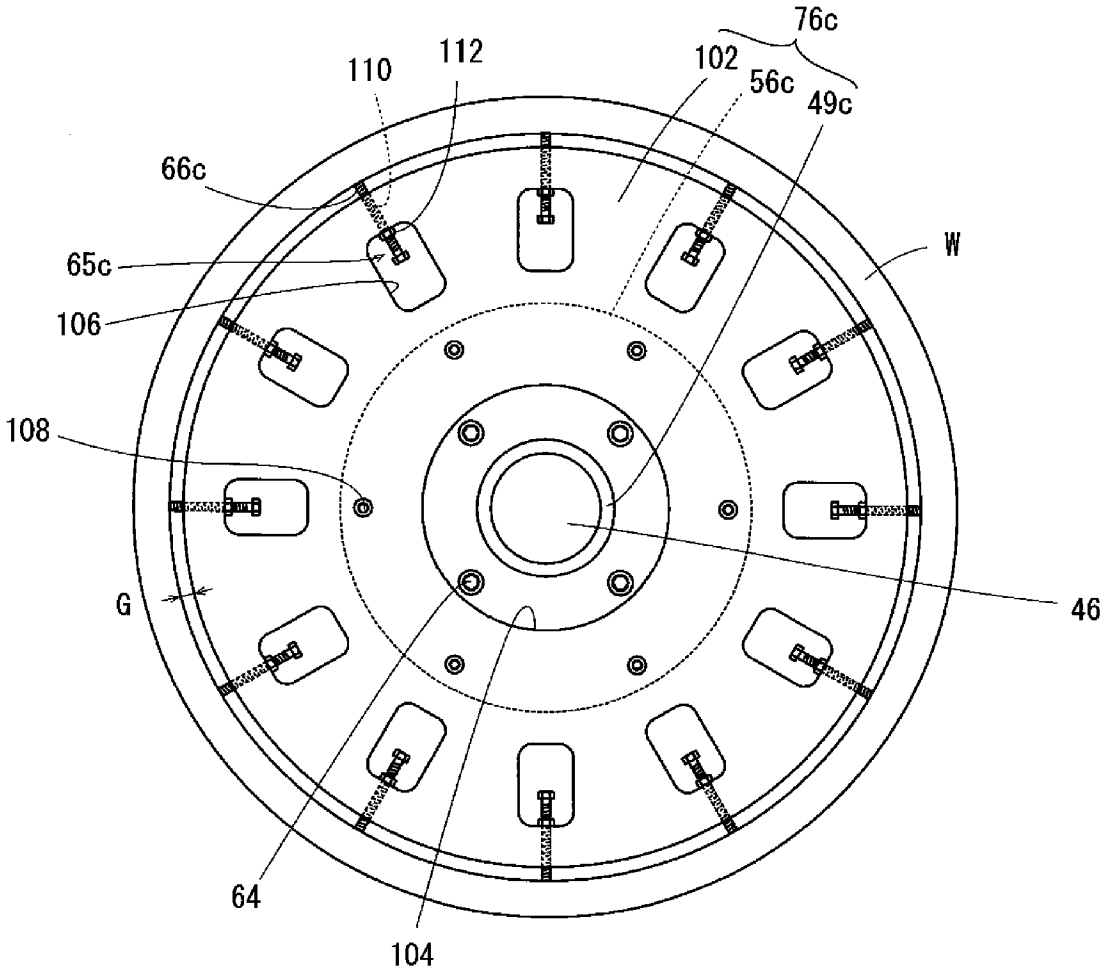
FIG. 11 is an illustrative side view which shows a primary portion of the double disc surface grinding machine in FIG. 10.

FIG. 10 and FIG. 11 show still another embodiment with an arrangement for individual position adjustment of each holding section.

Referring to FIG. 10 and FIG. 11, in the present embodiment, the work holding section 65 and the position adjustment section 76 of the double disc surface grinding machine 10 shown in FIG. 1 are replaced with a work holding section 65*c* and a position adjustment section 76*c*.

The position adjustment section 76*c* includes a screw ring 49*c*, a base flange 56*c* and a holding plate 102.

The screw ring 49*c* is generally cylindrical, and is made the same as the screw ring 49 except that the screw ring 49*c* does not have the screw holes 54. In other words, the screw ring 49*c* is at a center region in the disc section 48 of the rotation shaft 46, and includes a cylindrical section 50*c* and a flange section 52 formed at an end region of the cylindrical section 50*c*. The screw ring 49*c* is attached to the base flange 56*c*.

The base flange 56*c* is made the same as the base flange 56 except that the base flange 56*c* does not have the guide grooves 60 and the protrusions 61. In other words, the base flange 56*c* is substantially hollow and disc-like, and has a circular hollow portion 58 into which the screw ring 49*c* is inserted. While the cylindrical section 50*c* of the screw ring 49*c* is fitted to the hollow portion 58, the flange section 52 of the screw ring 49*c* is attached to the base flange 56*c* with fasteners 62. Then, the base flange 56*c*, to which the screw ring 49*c* is attached, is fixed to an end portion (the disc section 48) of the rotation shaft 46 with a plurality (four, in the present embodiment) of fasteners 64. The holding plate 102 is attached to the base flange 56*c*.

The holding plate 102 is hollow and disc-like, has a circular hollow region 104 through which the screw ring 49*c* is inserted, and a plurality (twelve, in the present embodiment) of substantially rectangular through-holes 106. The plurality of through-holes 106 are formed substantially equidistantly in a circumferential direction of the holding plate 102. The holding plate 102 has a thickness which is slightly smaller than an axial thickness T of the work W so as to give the holding plate 102 increased bending rigidity without a risk that the holding plate 102 will be ground by the grinding wheels 16*a*, 16*b*. Also, the holding plate 102 has an outer diameter which is slightly smaller than an inner diameter of the work W. The outer diameter of the holding plate 102 is designed to make a gap G of, e.g., approximately 5 mm, between the holding plate 102 and the work W. The holding plate 102 is fixed to the base flange 56*c* with a plurality (six, in the present embodiment) of fixing bolts 108. Therefore, the rotation shaft 46, the screw ring 49*c*, the base flange 56*c*, and the holding plate 102 are coaxial with each other and simultaneously rotatable. In each of the through-holes 106 in the holding plate 102, there is formed a screw hole 110 extending radially (in radial directions) of the holding plate 102, penetrating to reach an outer circumferential surface of the holding plate 102. The screw holes 110 are provided to penetrate an appropriate thickness position (substantial center region of the thickness, in the present embodiment) of the holding plate 102.

The work holding section 65*c* includes a plurality (twelve, in the present embodiment) of bolt-like holding members 66*c*. Each of the holding members 66*c* is threaded into a corresponding one of the screw holes 110, radially (in a radial direction) of the holding plate 102. The plurality of the holding members 66*c* are disposed substantially equidistantly in a circumferential direction of the holding plate 102. By rotating the holding members 66*c* (in a clockwise or counterclockwise direction), it is possible to move closer to and away from the holding members 66*c* with respect to the inner circumferential surface of the work W, radially of the rotation shaft 46. In other words, it is possible to advance or retract the holding members 66*c* with respect to the screw holes 110 thereby adjusting the position of the holding members 66*c* by way of interaction between male threads in the holding members 66*c* and female threads in the screw holes 110. The holding members 66*c* are thus rotated in the circumferential direction to move outward until tip portions of the holding members 66*c* press onto the inner circumferential surface of the work W. By doing so, the inner circumferential surface of the work W receives an appropriate amount of radially outward pressure evenly from a plurality (twelve, in the present embodiment) of the holding members 66*c*, and the work W is held by the plurality of holding members 66*c*, in an outwardly expanding (pushed from inside out) fashion. The holding members 66*c* are fixed with locknuts 112. Other arrangements are the same as the embodiment in FIG. 1, so repetitive description will not be given here.

According to this embodiment, the holding plate 102 which holds the holding members 66*c* is disc-like, and is formed as a single-piece without being divided in a circumferential direction. This allows the holding plate 102 to have a strong bending rigidity. Also, the embodiment allows the holding plate 102 to be increased in size until its outer diameter is close to the inner diameter of the work W. This allows the holding plate 102 to have a further increased bending rigidity. Further, a portion of each holding member 66*c* to be extended beyond the outer circumferential surface of the holding plate 102 is short, being equal to the dimension of the gap G. Thus, the holding members 66*c* resist bending forces and can become substantially integral with the holding plate 102. Therefore, each holding member 66*c* has substantially the same level of rigidity as the holding plate 102, i.e., it is possible to increase rigidity. This embodiment is advantageous particularly when the work W to be ground has a small thickness.

Figure 12:
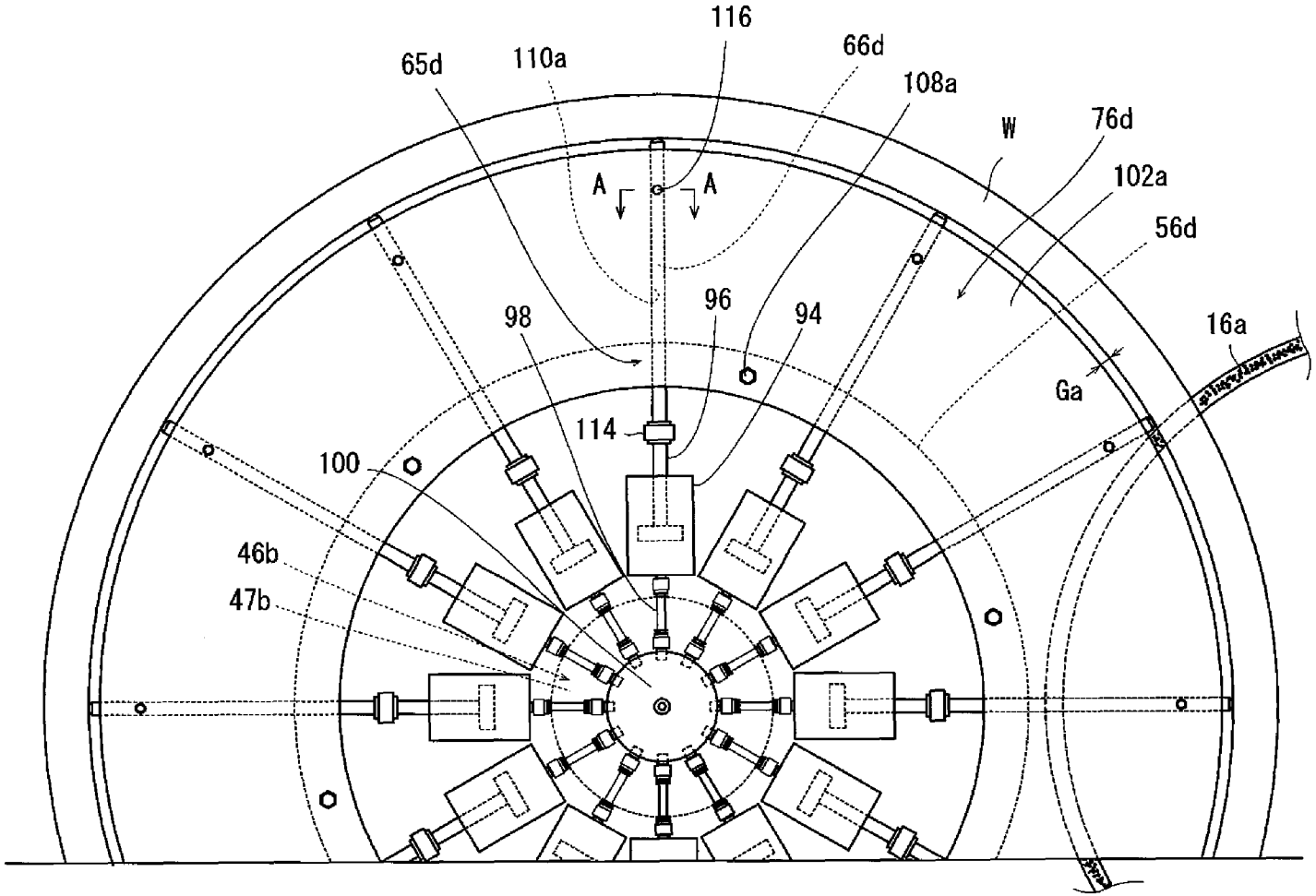
FIG. 12 is an enlarged view which shows a vicinity of a work holding section and a position adjustment section of a double disc surface grinding machine according to still another embodiment of the present invention.
Figure 13:
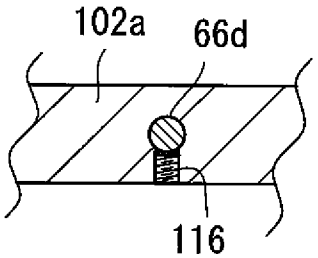
FIG. 13 is an illustrative sectional view taken in line A-A in FIG. 12.

The work may be automatically clamped and held according to an embodiment shown in FIG. 12 and FIG. 13.

Referring to FIG. 12 and FIG. 13, in the present embodiment, the work holding section 65*b* and the position adjustment section 76*b* in the embodiment shown in FIG. 8 are replaced with a work holding section 65*d* and a position adjustment section 76*d*.

The position adjustment section 76*d* includes a base flange 56*d*, air cylinders 94, pipes 98, an air supply joint 100, a holding plate 102*a*, and an air supply source.

The base flange 56*d* is the same as the base flange 56*b* except that the base flange 56*d* does not have the guide grooves 60 and the protrusions 61. In other words, the base flange 56*d* is formed substantially hollow and disc-like. An inner diameter of the base flange 56*d* is substantially equal to an outer diameter of the air supply joint 100. The base flange 56*d* is fitted around the air supply joint 100, and is fixed to the hollow disc section 48*b* (see FIG. 8) of the rotation shaft 46*b* with a plurality (four, in the present embodiment) of fasteners 64 (see FIG. 8). It should be noted here that although the embodiment in FIG. 12 has the hollow disc section 48*b* and the fasteners 64, FIG. 12 does not show the hollow disc section 48*b* and the fasteners 64 to avoid complication in the drawing. The same applies to FIG. 14 (which will be described later).

The holding plate 102*a* is hollow and disc-like. In order to give a high level of bending rigidity to the holding plate 102*a* and in order to prevent the holding plate 102*a* from being ground by the grinding wheels 16*a*, 16*b*, the holding plate 102*a* has a slightly smaller thickness than an axial thickness T (see FIG. 10) of the work W. Also, the holding plate 102*a* has an outer diameter which is slightly smaller than an inner diameter of the work W. The outer diameter of the holding plate 102*a* is designed to make a gap Ga of, e.g., approximately 5 mm, between the holding plate 102*a* and the work W. The holding plate 102*a* is fixed to an outer circumferential edge region of the base flange 56*d* with a plurality (six, in the present embodiment) of fixing bolts 108*a*. The holding plate 102*a* has a plurality (twelve, in the present embodiment) of through-holes 110*a*. The plurality of through-holes 110*a* are formed substantially equidistantly in a circumferential direction of the holding plate 102*a*, penetrating from an inner circumferential surface of the holding plate 102*a* to an outer circumferential surface thereof, radially (in radial directions). The through-holes 110*a* are provided to penetrate an appropriate thickness position (substantial center region of the thickness) of the holding plate 102*a*.

The work holding section 65*d* includes a plurality (twelve, in the present embodiment) of rod-like holding members 66*d*. The plurality of holding members 66*d* are disposed substantially equidistantly in a circumferential direction of the holding plate 102*a*. Each of the holding members 66*d* is inserted through a corresponding one of the through-holes 110*a* to extend radially (in a radial direction) of the holding plate 102*a* and to move inward and outward smoothly with respect to the inner circumferential surface of the work W radially of the rotation shaft 46*b*. Each holding member 66*d* is connected to a piston rod 96 of a corresponding one of cylinders 94, via a connection joint 114. Thus, as an unillustrated air supply source supplies air through the air supply joint 100 and each of the pipes 98, to each of the air cylinders 94 which is disposed in the base flange 56*d*, all of the holding members 66*d* move outward to press an inner circumferential surface of the work W thereby holding the work W. After clamping the work W, the holding members 66*d* are fixed with locking screws 116 threaded into the holding plate 102*a*, integrally with the holding plate 102*a* (see FIG. 13). Therefore, each holding member 66*d* has substantially the same level of rigidity as the disc-like holding plate 102*a*, i.e., it is possible to increase rigidity. Other arrangements are the same as the embodiment in FIG. 8, so repetitive description will not be given here.

Figure 14:
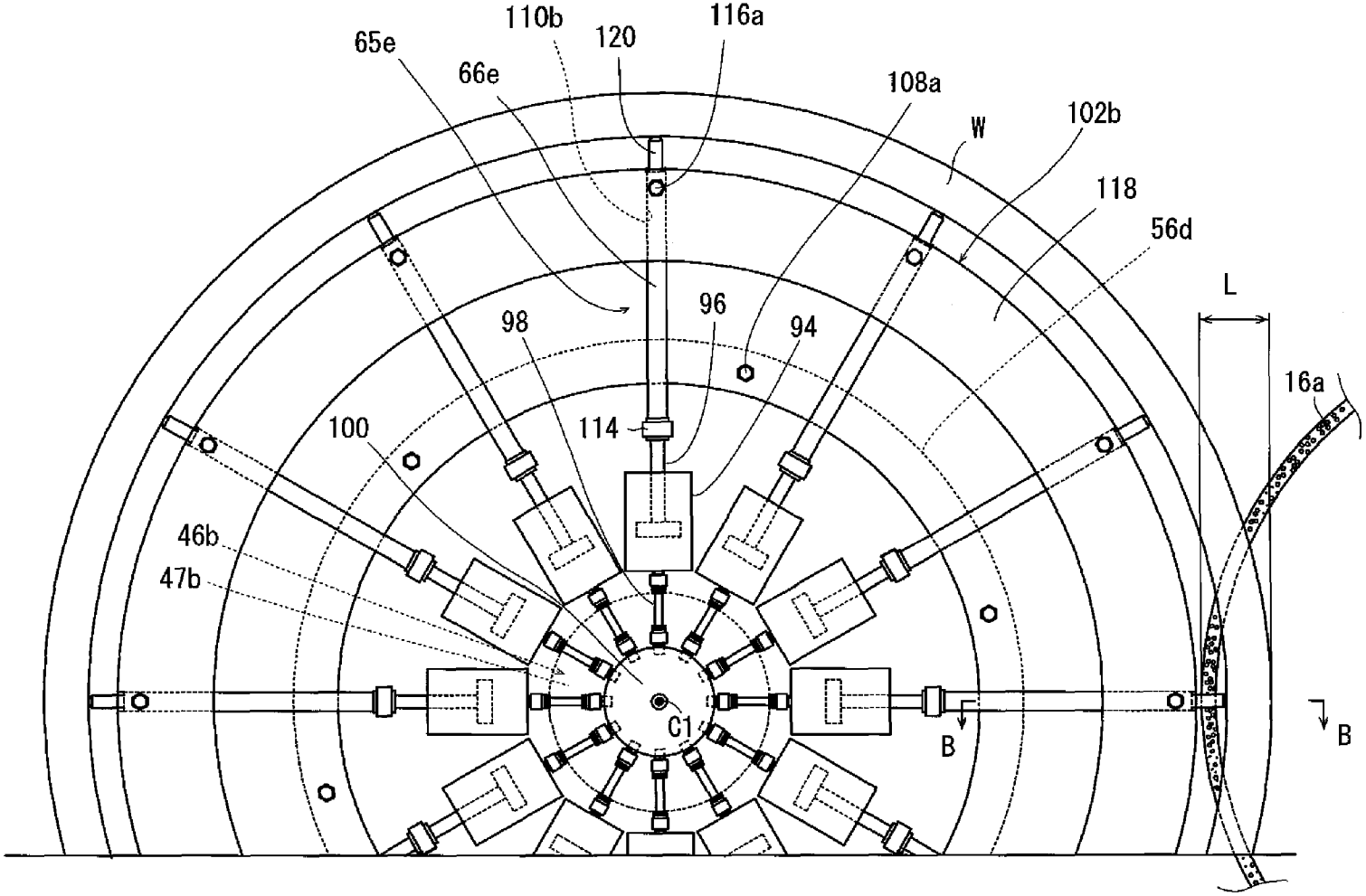
FIG. 14 is an enlarged view which shows a vicinity of a work holding section and a position adjustment section of a double disc surface grinding machine according to still another embodiment of the present invention.
Figure 15:
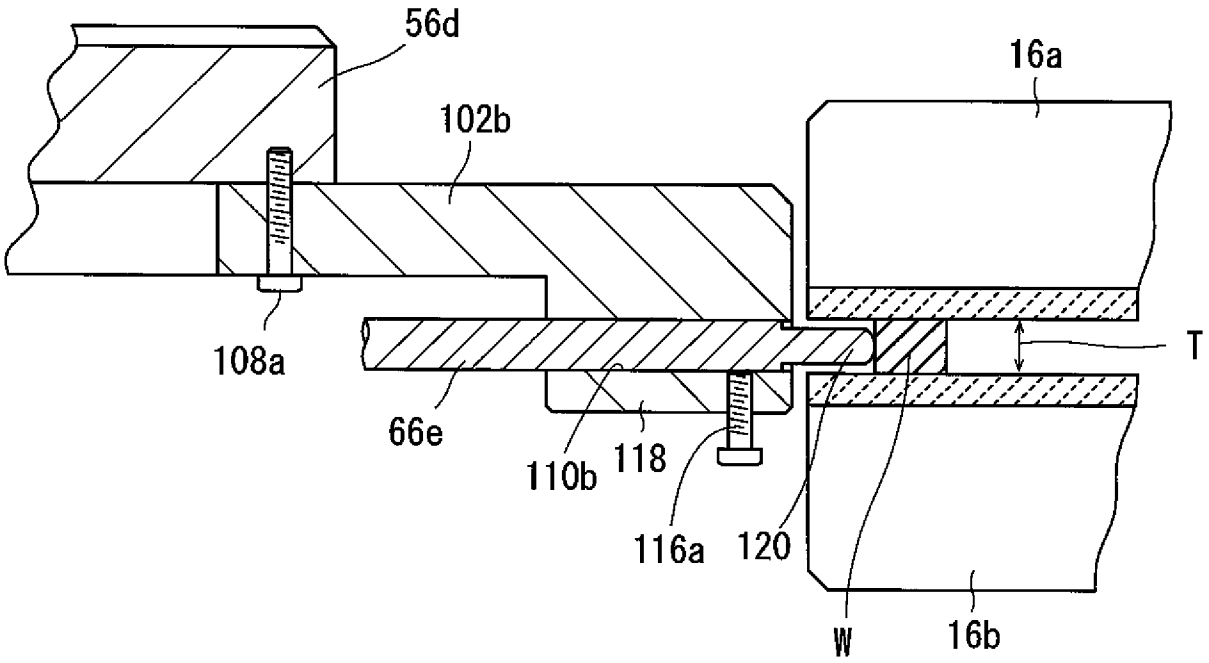
FIG. 15 is an illustrative sectional view taken in line B-B in FIG. 14.
Figure 16:
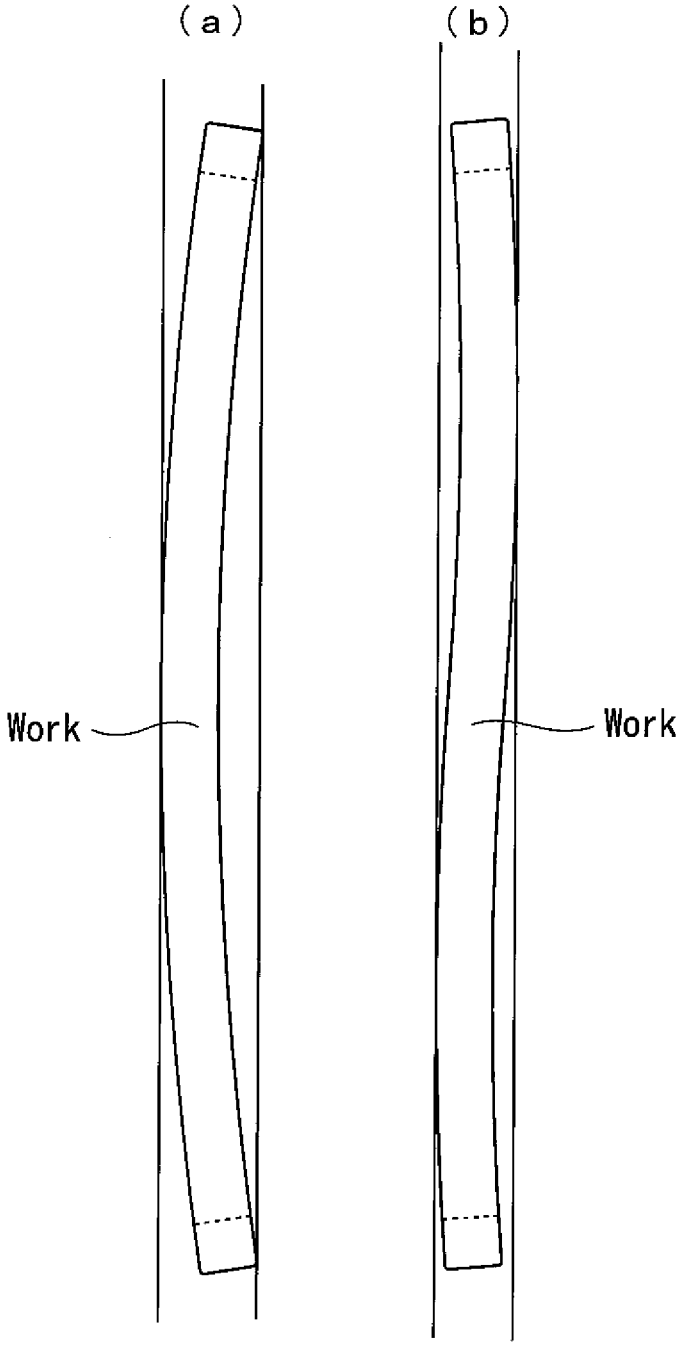
FIG. 16(*a*) shows a work having a mountain-shaped warp.
Figure 17:
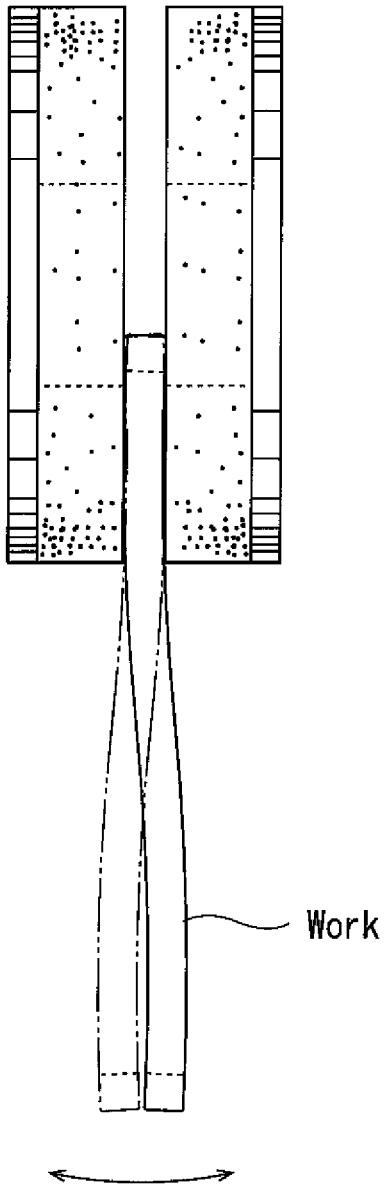
FIG. 17 is an illustrative drawing which shows a flailing movement of a work according to a conventional art.

Further, the work may be automatically clamped and held according to an embodiment shown in FIG. 14 and FIG. 15.

Referring to FIG. 14 and FIG. 15, in the present embodiment, the work holding section 65*d* and the holding plate 102*a* in the embodiment shown in FIG. 12 are replaced with a work holding section 65*e* and a holding plate 102*b*.

The holding plate 102*b* is hollow and disc-like, and has a thick portion 118 in its outer circumferential region. Therefore, the holding plate 102*b* is formed to have an L-shaped section in its outer circumferential region. For increased bending rigidity of the holding plate 102*b*, the thick portion 118 of the holding plate 102*b* may be made greater than an axial thickness T of the work W. Also, the holding plate 102*b* has an outer diameter which is slightly smaller than an inner diameter of the work W. The holding plate 102*b* is fixed to an outer circumferential edge region of the base flange 56*d* with a plurality (six, in the present embodiment) of fixing bolts 108*a*. The thick portion 118 of the holding plate 102*b* has a plurality (twelve, in the present embodiment) of through-holes 110*b*. The plurality of through-holes 110*b* are formed substantially equidistantly in a circumferential direction of the holding plate 102*b* (thick portion 118), penetrating from an inner circumferential surface of the thick portion 118 to an outer circumferential surface thereof, radially (in radial directions).

The work holding section 65*e* includes a plurality (twelve, in the present embodiment) of rod-like holding members 66*e*. The plurality of holding members 66*e* are disposed substantially equidistantly in a circumferential direction of the holding plate 102*b*. Each of the holding members 66*e* is inserted through a corresponding one of the through-holes 110*b* to extend in a radial direction (radially) of the holding plate 102*b* and to move inward and outward smoothly with respect to the inner circumferential surface of the work W radially of the rotation shaft 46*b*. Each of the holding members 66*e* has a tip portion 120, which has a slightly smaller diameter than a width T of the work W so that the tip portion 120 can be brought between the grinding wheels 16*a*, 16*b* without making contact with the grinding wheels 16*a*, 16*b* while holding the work W. By positioning an outer circumferential surface of the holding plate 102*b* closely to the grinding wheels 16*a*, 16*b*, it becomes possible to shorten a length of the tip portion 120. Part of the holding member 66*e* other than the tip portion 120 is outside of the grinding wheels 16*a*, 16*b* and therefore can be made thicker to give increased rigidity to the holding members 66*e*. Each holding member 66*e* is connected to a piston rod 96 of a corresponding one of cylinders 94, via a connection joint 114. After clamping the work W, the holding members 66*e* are fixed with locking screws 116*a* threaded into the holding plate 102*b*, and becomes integral with the holding plate 102*b*. Therefore, each holding member 66*e* has substantially the same level of rigidity as the disc-like holding plate 102*b*, i.e., it is possible to increase rigidity. Other arrangements are the same as the embodiment in FIG. 12, so repetitive description will not be given here.

According to this embodiment, there is no need for inserting the holding plate 102*b* between the grinding wheels 16*a*, 16*b*, so it is possible to increase the thickness of the holding plate 102*b* without being limited by the thickness of the work W, and therefore to further increase the rigidity of the holding plate 102*b*. Also, by shortening the length of the tip portion 120 in the holding member 66*e*, it becomes possible to further increase rigidity which is given by an integral structure of the holding plate 102*b* and the holding members 66*e*. Especially, this can be achieved more effectively by increasing a distance between the center C1 of the rotation shaft 46*b* which rotates the work W and the center of the grinding wheels 16*a*, 16*b* and decreasing a distance L (see FIG. 14) by which the work W is brought between the grinding wheels 16*a*, 16*b*, because these allow the tip portion 120 to be made shorter.

The present invention is not limited to cases where both in the pair of grinding wheels are advanced to the work, but is also applicable to cases where only one in the pair of grinding wheels is advanced to the work when the work is sandwiched by the pair of grinding wheels for grinding both main surfaces of the work.

In the embodiments described above, the present invention was applied to horizontal double disc surface grinding machines. However, the present invention is also applicable to vertical double disc surface grinding machines in which grinding wheel shaft is made vertical.

Also, the present invention is applicable not only to infeed grinding but also to so called creep feed grinding in which a rotating work is fed from outside of the grinding wheels toward the grinding wheels, and also to traverse creep feed grinding in which creep grinding is repeated.

The present invention being thus far described in terms of preferred embodiments, it is obvious that these may be varied in many ways within the scope and the spirit of the present invention. The scope of the present invention is only limited by the accompanied claims.

REFERENCE SIGNS LIST

10 Double disc surface grinding machine
16*a*, 16*b* Grinding wheels
26*a*, 26*b* Grinding wheel feeding sections
34 Rotation-driving section
46, 46*a*, 46*b* Rotation shafts
65, 65*a*, 65*b*, 65*c*, 65*d*, 65*e* Work holding sections
66, 66*a*, 66*b*, 66*c*, 66*d*, 66*e* Holding members
66*x* First holding member
66*y* Second holding member
66*z* Third holding member
76, 76*a*, 76*b*, 76*c*, 76*d* Position adjustment sections
C, C1 Rotation shaft centers
P Straight line which passes through the first location and the center of the rotation shaft
W, W1, W2 Works
x First location
y Second location
z Third location

The invention claimed is:

1. A double disc surface grinding machine for grinding two main surfaces of an annular work, the machine comprising:

a pair of rotary grinding wheels opposed to and spaced from each other in a first direction;

a rotation shaft extending in the first direction;

a work holding section for holding an inner circumferential surface of the work at a plurality of locations;

a position adjustment section connecting the rotation shaft and the work holding section to each other for adjusting a position of the work holding section radially of the rotation shaft;

a rotation-driving section for integrally rotating the rotation shaft, the position adjustment section, the work holding section and the work around the rotation shaft while the inner circumferential surface of the work is held by the work holding section; and a grinding wheel feeding section for feeding at least one of the grinding wheels to the work so as to sandwich part of the rotating work between the pair of grinding wheels thereby grinding two main surfaces of the work; wherein the position adjustment section includes a holding plate which holds the work holding section;

the holding plate has a part which is located between the pair of grinding wheels during grinding of the work, at least the part of the holding plate has a thickness which is smaller than an axial thickness of the work; and the work holding section which extends beyond an outer circumferential surface of the holding plate holds the inner circumferential surface of the work.

2. The double disc surface grinding machine according to claim 1, wherein the work holding section includes a plurality of holding members extending radially as viewed from the rotation shaft; and each of the holding members is movable radially inward and outward of the rotation shaft, and is contactable to the inner circumferential surface of the work.

3. The double disc surface grinding machine according to claim 2, wherein the position adjustment section is arranged to allow individual position adjustment of each of the holding members.

4. The double disc surface grinding machine according to claim 2, wherein the position adjustment section is arranged to allow simultaneous position adjustment of the plurality of holding members.

5. The double disc surface grinding machine according to claim 2, wherein the plurality of holding members include at least a first holding member, a second holding member and a third holding member, which satisfy the following condition that:

in the work's inner circumferential surface, with a first location which is defined as a location contacted by the first holding member, a second location which is defined as a location contacted by the second holding member, and a third location which is defined as a location contacted by the third holding member, the second location and the third location are on an opposite side from the side where the first location is, with respect to the rotation shaft; and the second location and the third location are on mutually opposite sides from each other with respect to a straight line which passes through the first location and the center of the rotation shaft.

6. The double disc surface grinding machine according to claim 1, wherein the rotation shaft and the work are concentric with each other.

7. A method of grinding two main surfaces of an annular work with a pair of rotating grinding wheels opposed to each other in a first direction at a space therebetween, the method comprising:

a holding step of holding an inner circumferential surface of the work at a plurality of locations with a work holding section which is held by a holding plate;

a rotating step of rotating the holding plate, the work holding section and the work integrally with each other around a rotation shaft which extends in the first direction; and a grinding wheel infeeding step of sandwiching part of the rotating work between the pair of grinding wheels and advancing at least one of the grinding wheels to grind two main surfaces of the work; wherein the holding plate has a part which is located between the pair of grinding wheels during grinding of the work, at least the part of the holding plate has a thickness which is smaller than an axial thickness of the work; and in the holding step, the work holding section which extends beyond an outer circumferential surface of the holding plate holds the inner circumferential surface of the work.

* * * * *